US008808029B2

(12) United States Patent
Castillo et al.

(10) Patent No.: US 8,808,029 B2
(45) Date of Patent: Aug. 19, 2014

(54) HIGH DENSITY CONNECTOR STRUCTURE FOR TRANSMITTING HIGH FREQUENCY SIGNALS

(71) Applicant: Speed Tech Corp., Taoyuan Hsien (TW)

(72) Inventors: Josue Castillo, Taoyuan Hsien (TW); James Patrick Young, Taoyuan Hsien (TW); Li-Sen Chen, Taoyuan Hsien (TW); Steven Wong, Taoyuan Hsien (TW); Hua-Chun Chang, Taoyuan Hsien (TW)

(73) Assignee: Speed Tech Corp., Taoyuan Hsien (TW)

( * ) Notice: Subject to any disclaimer, the term of this patent is extended or adjusted under 35 U.S.C. 154(b) by 77 days.

(21) Appl. No.: 13/761,160

(22) Filed: Feb. 7, 2013

(65) Prior Publication Data

US 2014/0024257 A1 Jan. 23, 2014

(30) Foreign Application Priority Data

Jul. 20, 2012 (TW) ..... 101214163 U

(51) Int. Cl.
*H01R 13/648* (2006.01)

(52) U.S. Cl.
USPC ..... 439/607.05; 439/95

(58) Field of Classification Search
USPC ..... 439/607.05, 95, 92
See application file for complete search history.

(56) References Cited

U.S. PATENT DOCUMENTS

| | | | | |
|---|---|---|---|---|
| 6,074,223 | A * | 6/2000 | Huang | 439/95 |
| 7,004,767 | B2 * | 2/2006 | Kim | 439/95 |
| 7,229,298 | B2 * | 6/2007 | Shen et al. | 439/95 |
| 7,524,193 | B2 | 4/2009 | Hashiguchi et al. | |
| 7,753,730 | B2 * | 7/2010 | Furio et al. | 439/607.08 |
| 8,167,631 | B2 | 5/2012 | Ito et al. | |
| 8,480,413 | B2 * | 7/2013 | Minich et al. | 439/95 |
| 2002/0061669 | A1 * | 5/2002 | Yu | 439/95 |
| 2005/0148240 | A1 * | 7/2005 | Kim | 439/610 |
| 2005/0287847 | A1 * | 12/2005 | Kamata et al. | 439/95 |
| 2006/0121782 | A1 * | 6/2006 | Shen et al. | 439/607 |
| 2009/0124120 | A1 * | 5/2009 | Wang et al. | 439/541.5 |
| 2012/0196458 | A1 * | 8/2012 | Zhang et al. | 439/95 |
| 2012/0214343 | A1 * | 8/2012 | Buck et al. | 439/607.05 |

* cited by examiner

*Primary Examiner* — Gary Paumen
(74) *Attorney, Agent, or Firm* — CKC & Partners Co. Ltd.

(57) ABSTRACT

A high density connector structure for transmitting high frequency signals having a first sub-assembly, a second sub-assembly, a shield plate, and a shield shell is disclosed. The first sub-assembly has a plurality of first contacts held in a first insulator, and the second sub-assembly has a plurality of second contacts held in a second insulator. The shield plate is positioned between the first and second contacts. At least one resilient arm extends from said shield plate and contacts at least one of the first contacts of the first sub-assembly. The shield shell at least partially surrounds the periphery of the first and second sub-assemblies.

18 Claims, 22 Drawing Sheets

A
B
B
B

HIGH DENSITY CONNECTOR STRUCTURE FOR TRANSMITTING HIGH FREQUENCY SIGNALS

RELATED APPLICATIONS

This application claims priority to Taiwan Application Serial Number 101214163, filed Jul. 20, 2012, which is herein incorporated by reference.

BACKGROUND

1. Field of Invention

The invention relates to a high density connector structure for transmitting high frequency signals. More particularly, the invention relates to a connector for transmitting high frequency electronic signals with a frequency level up to more than Megahertz/Gigahertz (MHz/GHz), and a plurality of contacts are arranged to be high density in a specific cross-sectional of the connector.

2. Description of Related Art

Since the amount of data transmitted between plural electronic devices are increased continuously, in order to provide more friendly using experience for users, the speed of transmitting signals between the electronic devices are increased accordingly. In order to enable the users to transmit a large amount of data in a shorter time, except increasing the number of signal paths for transmitting electronic signals between the electronic devices, currently the general solution is increasing the frequency of the electronic signals transmitted between the electronic devices. The connector is a bridge for transmitting electronic signals between different electronic devices. Under the condition that the frequency of the electronic signals transmitted between the different electronic devices are increased continuously, also considering the unfavorable effect of the high frequency electronic signals passing through the connector, the cause of the unfavorable effect of the high frequency electronic signals should be controlled and take appropriate treatments to reduce the substantive effect, to make the high frequency electronic signals be integrally transmitted between the electronic devices.

Due to a trend of minimizing volumes of electronic devices, the entire volume of the connector should be reduced (i.e., the density of contacts in a specific cross-sectional is increased) accordingly, and in order to increase the number of paths for transmitting electronic signals in the connector, the distance between conductive contacts arranged on the connector is reduced continuously. However, the condition that the distance between conductive contacts arranged on the connector is reduced continuously and is unfavorable for the transmission of high frequency electronic signals. This is because that the high frequency electronic signals transmitted between the conductive contacts will easily cause the crosstalk, which further causes generation of noise to the original transmitted high frequency electronic signals.

In a known prior art, the U.S. Pat. No. 8,167,631 disclosed a card edge connector, which is a high density connector for transmitting high frequency electronic signals. The card edge connector is used for transmitting a differential signal, wherein two ground line contacts (G) are arranged respectively at the outer sides of two adjacent signal line contacts (S), so that the contacts are arranged in a G-S-S-G state. The card edge connector is mainly formed by fixing a plurality of signal line contacts B and ground line contacts C to an insulator A. As shown in FIG. 24, the card edge connector uses a common contact D to transversely over the two signal line contacts B and to connect the two ground line contacts C, so that the two ground line contacts C can exchange electrical charges with each other and thus have the same electric potential. In the description of the conventional art, in order to avoid that the signal line contacts B accidentally contact the common contact D, the signal line contacts B crossed by the common contact D are all provided with a groove (not shown). For this prior art, the difficult of forming the groove on a metal sheet for the signal line contacts B, the impedance variation of signal line contacts during the transmission of the high frequency electronic signals caused by the groove, the disadvantage that the signal line contacts B, the common contact D and the ground line contacts C should be assembled in different batches, and the like all show that the design of the card edge connector is not economical.

As shown in FIGS. 25, 25-1 and 25-2, in another known prior art the U.S. Pat. No. 7,524,193, which discloses a connector with excellent high frequency character, mainly formed by a built-in circuit board E, an insulator A, a plurality of signal line contacts B, a plurality of ground line contacts C and a metal shield F. The built-in circuit board E is positioned on the insulator A, and the plurality of signal line contacts B and the plurality of ground line contacts C are respectively welded on appropriate positions on the built-in circuit board E, so that the built-in circuit board E can be electrically connected with the circuit board outside the connector through the plurality of signal line contacts B and the plurality of ground line contacts C. In this prior art, the built-in circuit board E extends from the outer side of the insulator A towards the mating connector for a certain distance to form a tongue-shaped plate E1; the two opposite surfaces of the tongue-shaped plate E1 are each provided with a plurality of circuit contacts E11, and the connector can be mated and electrically connected with a mating connector through the circuit contacts E11 of the inner circuit board E.

In the disclosure of the U.S. Pat. No. 7,524,193, the circuit contacts E11 of the built-in circuit board E at least can be connected to appropriate signal line contacts B or ground line contacts C through the electronic circuit (not shown) on the built-in circuit board E. Therefore appropriate impedance compensation can be obtained by adjusting the circuit arrangement on the built-in circuit board E and by adjusting the welding positions of the built-in circuit board E, the signal line contacts B and the ground line contacts C, so as to reasonably control the electrical characters of the components of the connector. However, in the disclosure of this prior art, the connector is directly mated with the mating connector (not shown) through the circuit contact E11 on the tongue-shaped plate E1 so that when two connectors are subjected to a repeat mating and unmating test, the contacts of the mating connector will continuously swipe the circuit contact E11 arranged on two opposite surfaces of the tongue-shaped plate E1, which causes that the fibers at the edges of the tongue-shaped plate E11 may be scrolled during the mating and unmating test, and thus the structure of the tongue-shaped plate E1 is continuously damaged, finally causing the failure of the connector.

Since the connector structure for transmitting high frequency signals disclosed in the above two prior arts both have the disadvantage of inefficient, it is necessary to provide an improved design for the high density connector for transmitting high frequency electronic signals.

SUMMARY

The invention provides a high density connector structure for transmitting high frequency electronic signals. The connector is at least applicable to transmitting electronic signals with the frequency level more than Megahertz/Gigahertz (MHz/GHz), and the high density connector refers to a connector which has a plurality of conductive contacts in a specific cross-sectional, and that means the distance between each two of these conductive contacts of the connector is small.

The invention provides a high density connector structure for transmitting high frequency signals, wherein a plurality of contacts are arranged in a specific cross-sectional of the connector, and generally, the distance between each two of these contacts of the connector is no more than 1 mm.

In order to achieve the abovementioned purpose and features of the invention, the invention is to be disclosed through the specific embodiments in the following detailed description. In an embodiment of the invention, the connector structure mainly comprises a first sub-assembly, a second sub-assembly, a shield plate and a shield shell. The first sub-assembly has a plurality of first contacts held in a first insulator, and the second sub-assembly has a plurality of second contacts held in a second insulator. The first sub-assembly and the second sub-assembly can interfere with each other through an assembly structure, so that an appropriate frictional force is caused between the first sub-assembly and the second sub-assembly to retain the relative positions thereof. The shield plate is positioned between the first sub-assembly and the second sub-assembly, and is formed by cutting a metal sheet. A resilient arm extends from the shield plate and contacts at least one ground line contact of the first sub-assembly, so that the resilient arm is electrically connected with the ground line contact. The shield shell at least partially surrounds the periphery of the first and second sub-assemblies.

BRIEF DESCRIPTION OF THE DRAWINGS

FIG. 4-1 is a cross-sectional view of FIG. 4 along the line A-A;

FIG. 5-1 is a cross-sectional view of FIG. 5 along the line B-B;

FIG. 5-2 is a cross-sectional view of FIG. 5 along the line C-C;

FIG. 5-3 is a partial enlarged view of section Z of FIG. 5-1;

FIG. 9-1 is a cross-sectional view of FIG. 9 along the line D-D;

FIG. 10-1 is a cross-sectional view of FIG. 10 along the line E-E;

FIG. 10-2 is a cross-sectional view of FIG. 10 along the line F-F;

FIG. 10-3 is a partial enlarged view of section Y of FIG. 10-1;

FIG. 15-1 is a cross-sectional view of FIG. 15 along the line G-G;

FIG. 19-1 is a cross-sectional view of FIG. 19 along the line H-H;

FIG. 19-2 is a cross-sectional view of FIG. 19 along the line I-I;

FIG. 23-1 is a cross-sectional view of FIG. 23 along the line J-J;

FIG. 25-1 is a side view of FIG. 25; and

FIG. 25-2 is a top view of FIG. 25.

DETAILED DESCRIPTION

Figure 1:
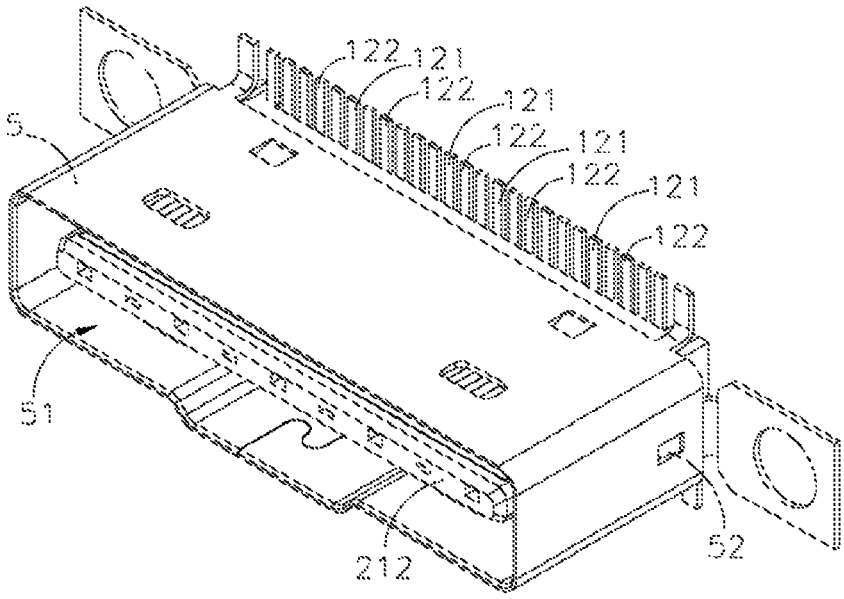
FIG. 1 is a perspective view of a first embodiment of the invention.
Figure 2:
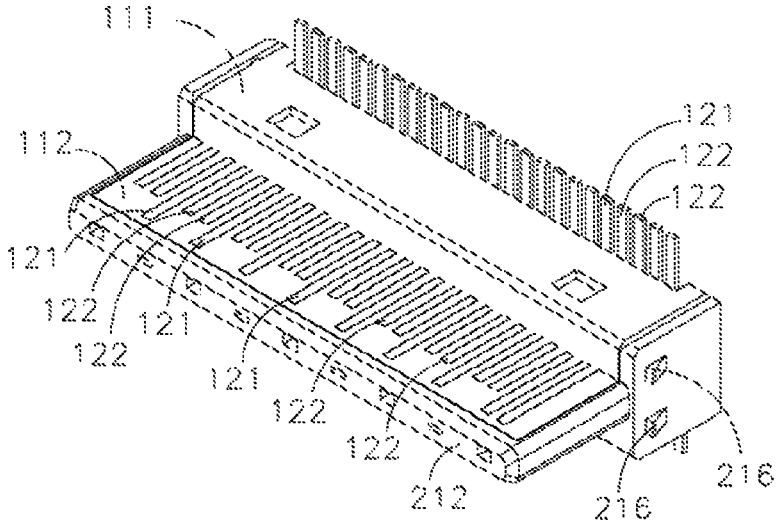
FIG. 2 is a schematic view of FIG. 1, in which the shield shell is omitted.
Figure 3:
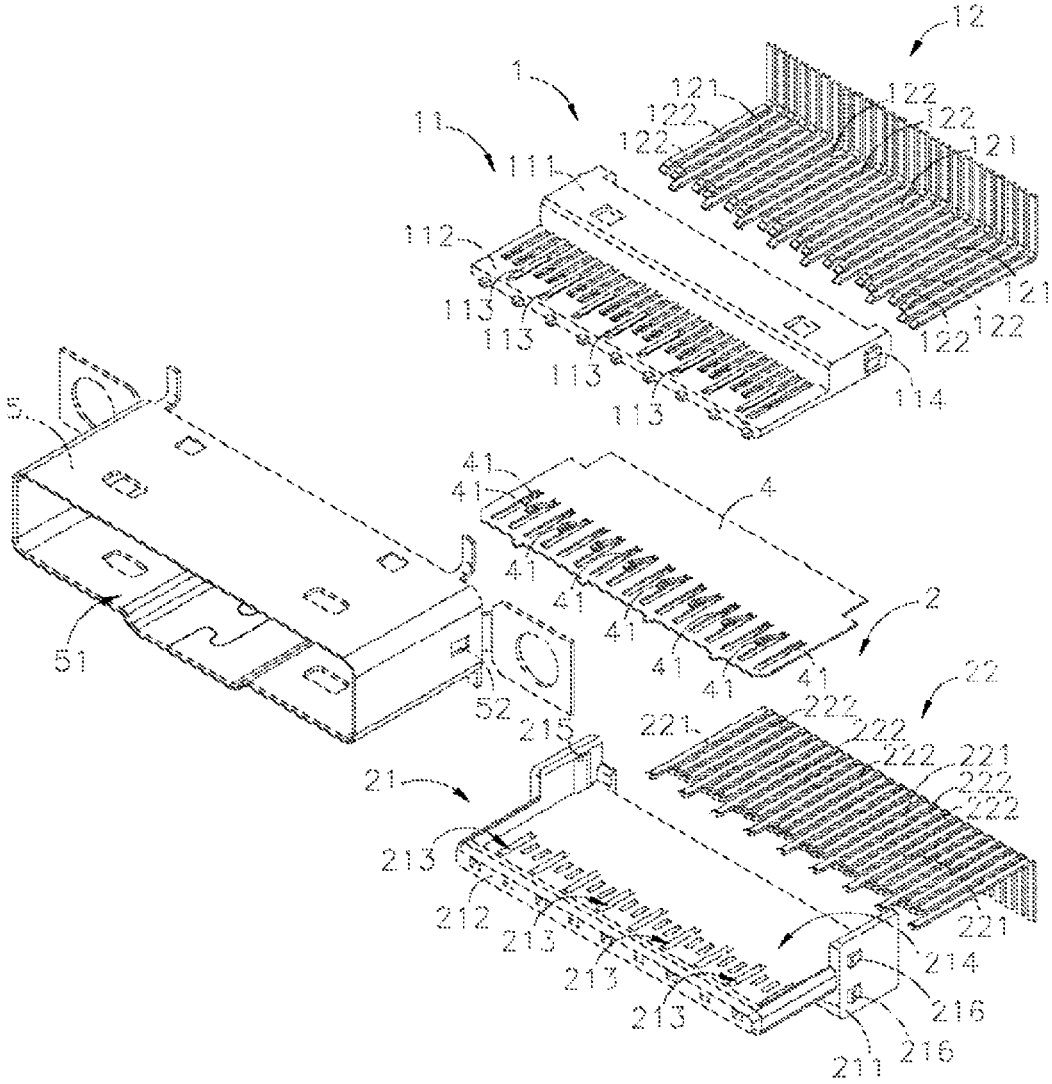
FIG. 3 is a perspective exploded view of FIG. 1.

As shown in FIGS. 1, 2 and 3, a first embodiment of the invention mainly discloses a high density connector structure including a first sub-assembly 1, a second sub-assembly 2, a shield plate 4 and a shield shell 5. The first sub-assembly 1 is formed by a first insulator 11 and a set of first contacts 12 held in the first insulator 11, and the second sub-assembly 2 is formed by a second insulator 21 and a set of second contacts 22 held in the second insulator 21. The first contact 12 and the second contact 22 respectively include a plurality of ground line contacts 121, 221 and a plurality of signal line contacts 122, 222. In the first embodiment, the first insulator 11 and the second insulator 21 are respectively directly formed on the surfaces of the first contact 12 and the second contact 22.

The shield plate 4 is substantially formed by cutting a metal sheet material. The shield plate 4 is bent as having a plurality of resilient arms 41, each of these resilient arms 41 has an elastic-restoring force after being elastic-deformed under a force. The shield plate 4 is positioned between the first contact 12 of the first sub-assembly 1 and the second contact 22 of the second sub-assembly 2. The shield shell 5 at least partially surrounds the periphery of the first contact 12 and the second contact 22, and an opening 51 is preset on the shield shell 5 at a mating surface of the connector, so that the connector can mate with a mating connector (not shown) through the opening 51 of the shield shell 5. In the first embodiment, in the range of the opening 51 of the shield shell 5, the first contact 12 and the second contact 22 are arranged in two columns, i.e., the upper and lower columns. Therefore the first contact 12 can be regarded as the upper column, and the second contact 22 can be regarded as the lower column.

In the first embodiment of the invention, substantially the upper-column contacts of the first sub-assembly 1 can be simply divided into a plurality of ground line contacts 121 and a plurality of signal line contacts 122, and the lower-column contacts of the second sub-assembly 2 can be substantially divided into a plurality of ground line contacts 221 and a plurality of signal line contacts 222. In the figures of the first embodiment, the ground line contacts 121, 221 and the signal line contacts 122, 222 can be distinguished from the lengths thereof; but it is only for convenience of description to draw respective lengths of contacts to represent respective functions of signals transmitted by the contacts, and it does not mean that the contacts of the first embodiment only has two functions of transmitting ground line signals and transmitting high frequency electronic signals. Actually, in the figures of the first embodiment, at least two adjacent contacts respectively with a relative long length and a relative short length can be used to transmit power, but it will make the disclosure of the specification more complex to differentiate and describe the types and functions of respective electronic signals transmitted by respective contacts.

Figures 1, 4:
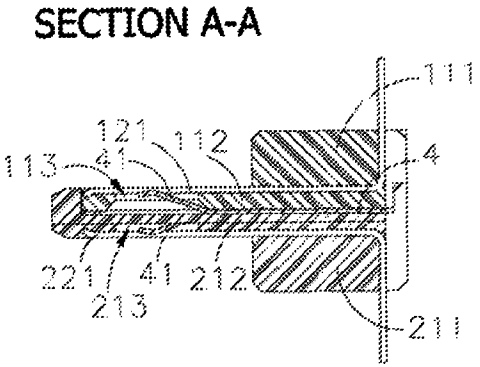
FIG. 4 is a front view of FIG. 2.
Figure 4:
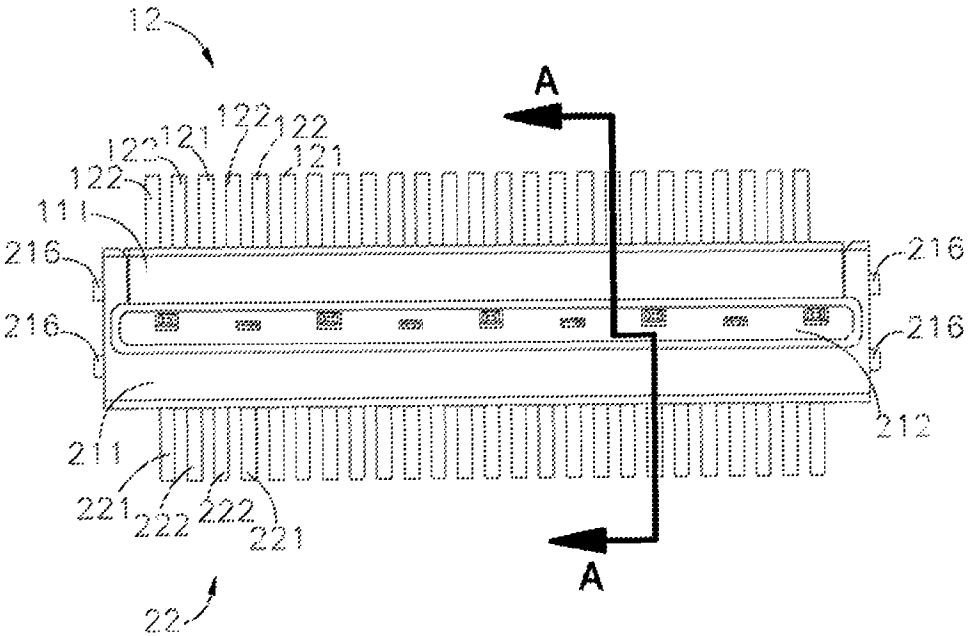

As shown in FIGS. 3, 4 and 4-1, the first insulator 11 is directly formed on an outer surface of the first contact 12 through an insert molding method or an in-mold decoration (IMD) method, and the second insulator 21 is directly formed on an outer surface of the second contact 22 through the insert molding method. The first sub-assembly 1 and the shield plate 4 are laminated on the second sub-assembly 2, and a tongue-shaped plate extends both from the first sub-assembly 1 and the second sub-assembly 2 to the opening 51 of the shield shell 5 (as shown in FIG. 1), so that the first contact 12 and the second contact 22 are respectively arranged on two opposite surfaces of the tongue-shaped plate.

In the first embodiment, the first insulator 11 is formed by a main body portion 111 and an extending portion 112, and the second insulator 21 is formed by a main body portion 211 and an extending portion 212. The main body portions 111 and 211 of the first insulator 11 and the second insulator 21 at least respectively support the extending portions 112 and 212, so that the extending portions 112 and 212 are arranged as departing from the top surface or the bottom surface of the whole connector with a certain distance. After the first insulator 11 and the second insulator 21 are assembled, the respective extending portions 112 and 212 of the first and second insulators 11 and 21 extend jointly towards the opening 51 of the shield shell 5 (as shown in FIG. 1), so that the respective extending portions 112 and 212 of the two insulators 11 and 21 jointly form the tongue-shaped plate.

Figure 5:
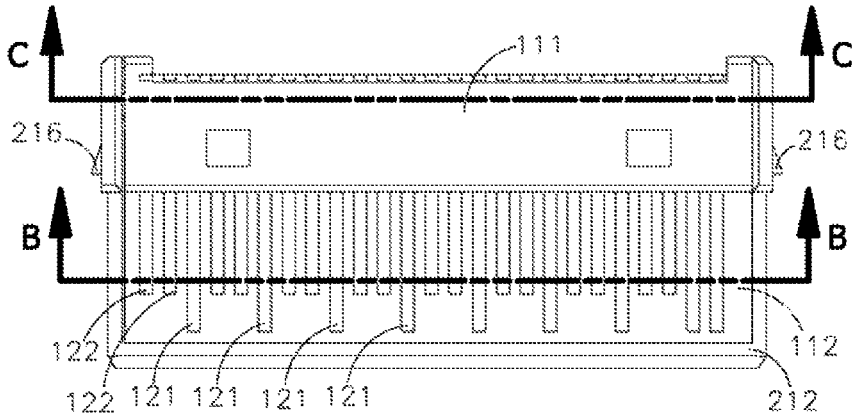
FIG. 5 is a top view of FIG. 2.
Figures 1, 5:
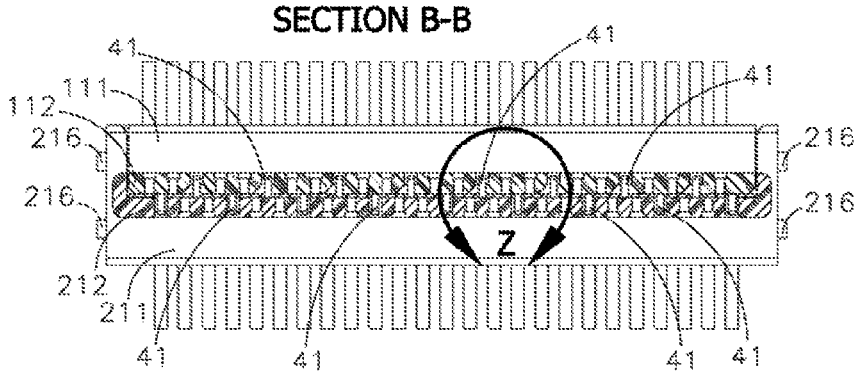
Figures 2, 5:
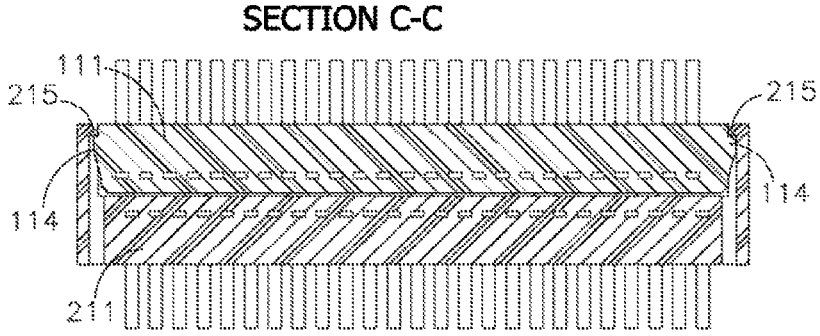
Figures 3, 5:
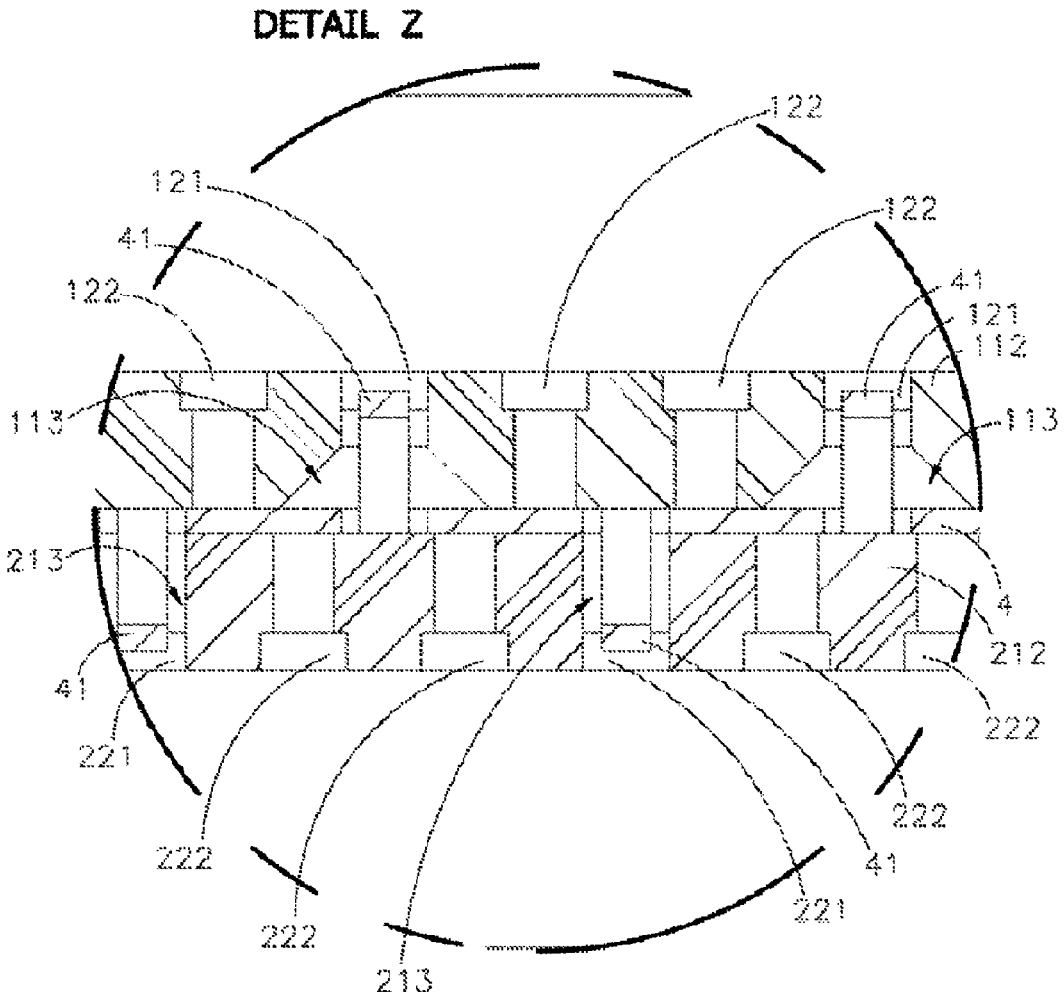

As shown in FIGS. 4-1, 5 and 5-1, the shield plate 4 of the first embodiment is formed by cutting a metal sheet, so that the shield plate 4 itself has the function of shielded electromagnetic waves, so that it does not cause an electromagnetic crosstalk phenomenon when the first contact 12 and the second contact 22 transmit high frequency electronic signals. In the first embodiment, the plurality of resilient arms 41 extends from the shield plate 4 and each contact the ground line contacts 121 and 221 of the first sub-assembly 1 and the second sub-assembly 2, so that the ground line contacts 121 and 221 are electrically connected with respective resilient arms 41 of the shield plate 4.

As shown in FIGS. 4-1, 5-1 and 5-3, in the first embodiment, it is predicted that the plurality of resilient arms 41 of the shield plate 4 are all elastic-deformed after the connector is assembled, so that the plurality of resilient arms 41 can be used to abut against the ground line contacts 121 and 221 due to the elastic-restoring force of the resilient arms 41, to ensure the mechanical contact state between the resilient arms 41 and the ground line contacts 121 and 221, and thus the ground line contacts 121 and 221 and the resilient arms 41 have the same electric potential. The ground line contacts 121 and 221 can exchange charges with or transmit charges to each other as being electrically connected to the shield plate 4, so that the charges on the shield plate 4 and the ground line contacts 121 and 221 can be grounded quickly through multiple paths.

In the first embodiment, the shield plate 4 is positioned between the first contact 12 and the second contact 22, so that the arrangement of the shield plate 4 has a great effect on the whole transmitting process of high frequency electronic signals performed by the connector. For example, factors such as the distance between the shield plate 4 and each length of the signal line contacts 122 and 222, and the shape of the shield plate 4 greatly affect the impedances of the signal line contacts 122 and 222 during the transmission process of the high frequency electronic signals on the signal line contacts 122 and 222. It is already known that the variation of impedances of the signal line contacts 122 and 222 causes energy loss or return loss during the transmission process of the high frequency electronic signals, and the design of the signal line contacts 122 and 222 inevitably cause the variation of impedances, so that those skilled in the art can fine tune the sizes of elements of the shield plate 4 or the distance from the shield plate 4 to the signal line contacts 122 and 222 to obtain an appropriate impedance compensation.

In order to make the resilient arms 41 of the shield plate 4 each contact respective ground line contacts 121 and 221 of the first sub-assembly 1 and the second sub-assembly 2, the extending portions 112 and 212 of the first insulator 11 and the second insulator 12 respectively can be provided with multiple through holes 113 and 213, and thus the resilient arms 41 of the shield plate 4 can be electrically connected to corresponding ground line contacts 121 and 221 by passing through appropriate through holes 113 and 213. In the figures disclosed in this embodiment, the number of the through holes 113 and 213 on the first insulator 11 and the second insulator 12 is the same as the number of the resilient arms 41 of the shield plate 4. However, this is only an available design scheme, and those skilled in the art can expand or connect through holes 113 and 213 at different positions to make the plurality of resilient arms 41 of the shield plate 4 all pass through the same one of the through holes 113 and 213 on the first insulator 11 or the second insulator 12.

As shown in FIGS. 2 and 3, in order to make the first sub-assembly 1 and the second sub-assembly 2 be combined tightly and to retain the relative positions thereof, the extending portion 212 of the second insulator 21 is provided with a groove 214 on a surface facing the extending portion 112 of the first insulator 1. The groove 214 of the second insulator 21 at least can accommodate the shield plate 4 and a part of the extending portion 112 of the first insulator 11. The two sub-assemblies 1 and 2 interfere with each other through an assembly structure to generate enough frictional force to retain the relative positions of the two sub-assemblies 1 and 2.

As shown in FIGS. 3, 5 and 5-2, in this embodiment, in addition to including the groove 214 on the extending portion 212 of the second insulator 21, the assembly structure further includes a pair of button hooks 114 of the first insulator 11, and a pair of stopping blocks 215 of the second insulator 21 corresponding to the button hooks 114 of the first insulator 11. When the shield plate 4 and the extending portion 112 of the first insulator 11 are laminated in the groove 214 of the second insulator 21, the button hooks 114 of the first insulator 11 can be fastened with the stopping blocks 215 of the second insulator 21, so that a frictional force is caused on the contacting surface of the first insulator 11 and the second insulator 21 to prevent the first insulator 11 from dropping out from the groove 214 of the second insulator 21.

In the first embodiment, in order to ensure that the second sub-assembly 2 does not be separated from the shield shell 5, two pair of convex shoots 216 extends respectively from two sides of the main body portion 211 of the second insulator 21 towards the shield shell 5. A frictional force is provided due to the interference between the convex shoots 216 and the inner edges of the opening 51 of the shield shell 5, so that the shield shell 5 is fixed at a certain position outside the second insulator 21, and the first insulator 11 is fixed at a predetermined position of the shield shell 5 indirectly through the interaction between the second insulator 21 and the shield shell 5. In order to increase the frictional force between the shield shell 5 and the second insulator 21 two barbs 52 respectively extend from two sideshow of the shield shell 5 towards the main body portion 211 of the second insulator 21, and thus through the frictional force provided by the barbs 52 of the shield shell 5, the second insulator 21 is prevented from dropping off from the opening 51 of the shield shell 5.

Figure 6:
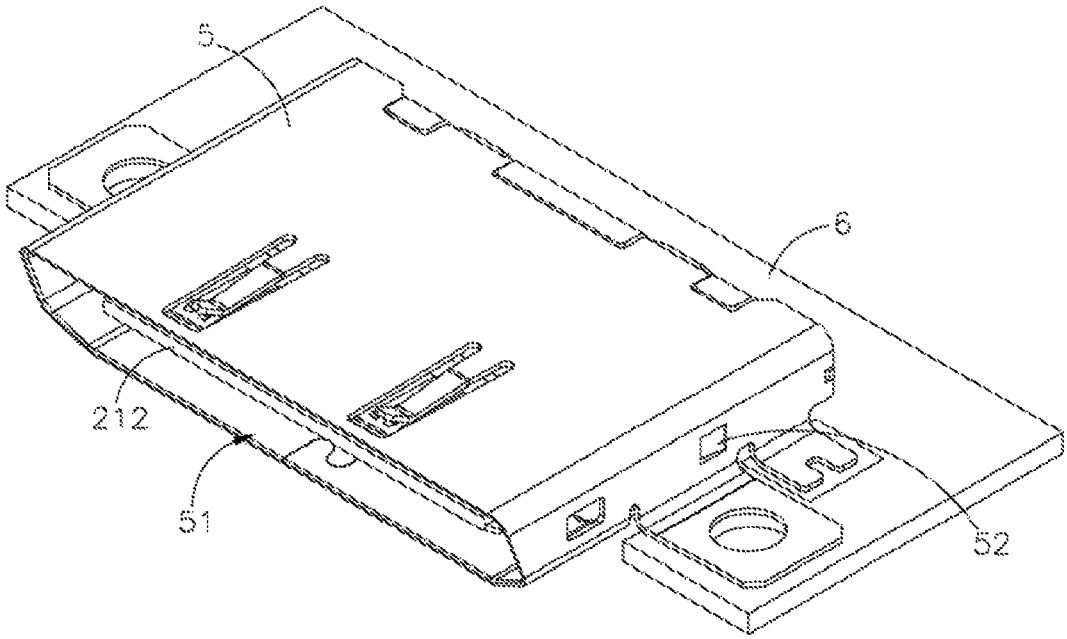
FIG. 6 is a perspective view of a second embodiment of the invention being assembled in a circuit board.
Figure 7:
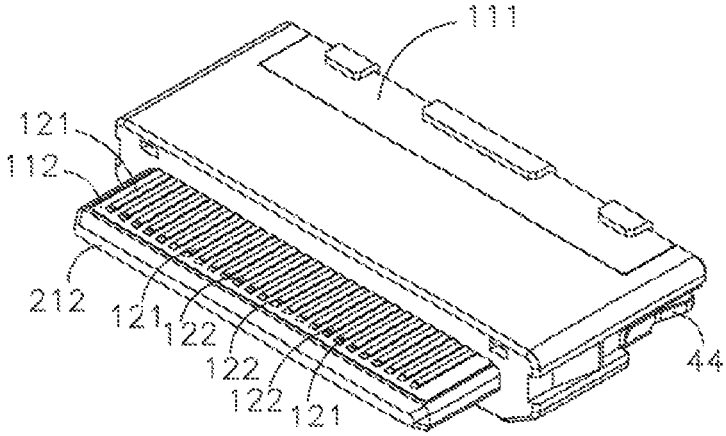
FIG. 7 is a schematic view of FIG. 6, in which the shield shell and the circuit board are omitted.
Figure 8:
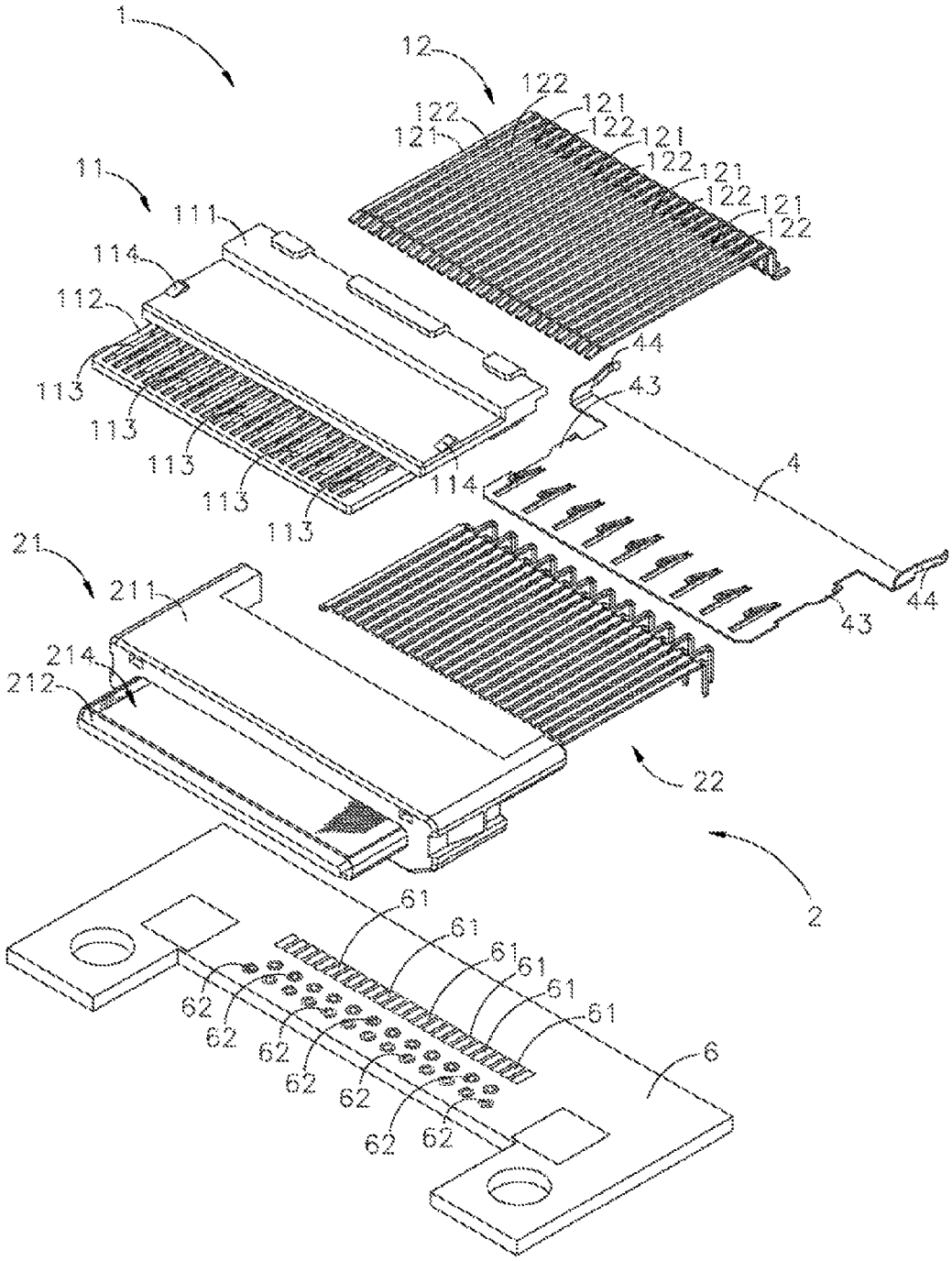
FIG. 8 is a perspective exploded view of FIG. 6, in which the shield shell is omitted.

As shown in FIGS. 6, 7 and 8, a second embodiment of the invention does not use the same structure disclosed in the above-mentioned first embodiment, but the second embodiment mainly use the same physical principle as the first embodiment, so that the following description and drawing illustration of the second embodiment use the same term, definition and numerical number as referred in the first embodiment for the component corresponding to that of the first embodiment. The structures and features which do not disclosed in details in the second embodiment can be inferred with reference to the description and drawing illustration of the first embodiment by those skilled in the art. Similarly, the following embodiments of the invention all use the same term, definition and numerical number as referred in the first embodiment for the component corresponding to that of the first embodiment, and the structures and features which do not disclosed in details in the following embodiments directly can be inferred with reference to the description and drawing illustration of the previous embodiment or the first embodiment by those skilled in the art.

In the second embodiment, the first insulator 11 is directly formed on the first contact 12, and the second contact 22 of the second insulator 21 interferes with the second insulator 21 through a conventional interference method, so that the second contact 22 is fixed on a predetermined position on the second insulator 21. The difference between the disclosures of second embodiment and the first embodiment is that in the second embodiment the first contact 12 and the second contact 22 has no obvious length differences; the connector of the second embodiment is designed as a connector applicable to be assembled at a board end of a circuit board (not shown) (as shown in FIG. 6); but the contacts of the first embodiment has a common flat surface, so that in addition to being welded to a circuit board, the contacts can also be fixed to the end of a strand of cables (not shown), and thus the connector of the first embodiment can be formed as a cable end connector (as shown in FIG. 1). The main factor for determining whether the connector is a board end connector or a cable end connector is that whether the contacts of the connector is welded to the circuit board or the end of a strand of cables.

As shown in FIGS. 7 and 8, the first contacts 12 of the second embodiment of the invention are surface mount contacts, which can be electrically connected with the circuit contacts exposed on the surface of a circuit board (not shown); and the second contacts 22 are through hole contacts, which can be welded to the through holes of the circuit board. That is, the application range of the second embodiment of the invention is not limited to the application range of the surface mount contact or the through hole contact.

In the second embodiment, a pair of contacting limbs 44 extends from the shield plate 4 towards the outer side of the second insulator 21. After the shield shell 5 is assembled with the first sub-assembly 1 and the second sub-assembly 2, the contacting limbs 44 of the shield plate 4 each contact the shield shell 5 (as shown in FIG. 6), so that the shield shell 5, the shield plate 4 and respective ground line contacts 121 have the same electrical potential. Furthermore, the mating connector (not shown) also has a shield shell which contacts the shield shell 5 of the connector. At this time in addition to being grounded through the ground line contacts 121 contacting with the resilient arms 41, the shield plate 4 can also be grounded through the shield shell 5 by using the shield shell of the mating connector, which can improve the ground efficiency of the whole connector.

Figures 1, 9:
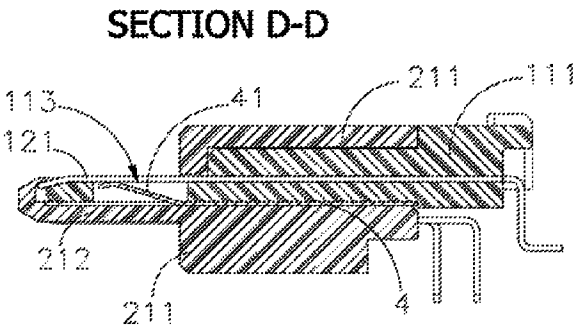
FIG. 9 is a front view of FIG. 7.
Figure 9:
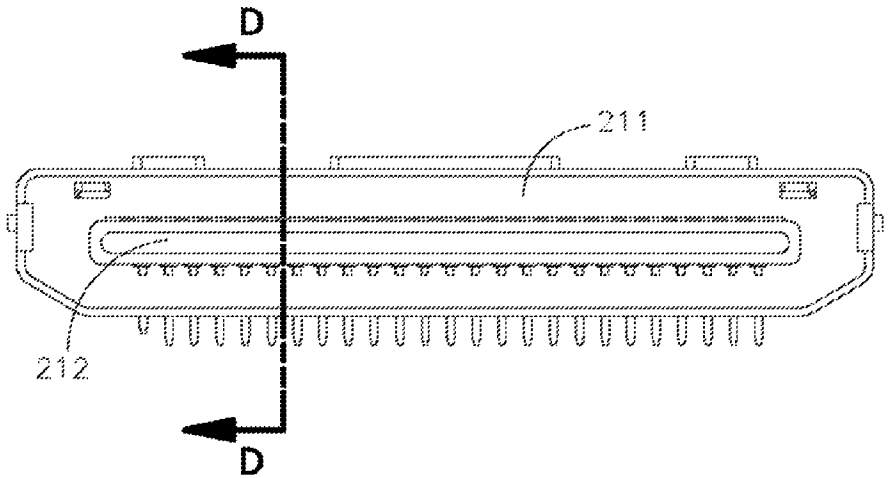
Figure 10:
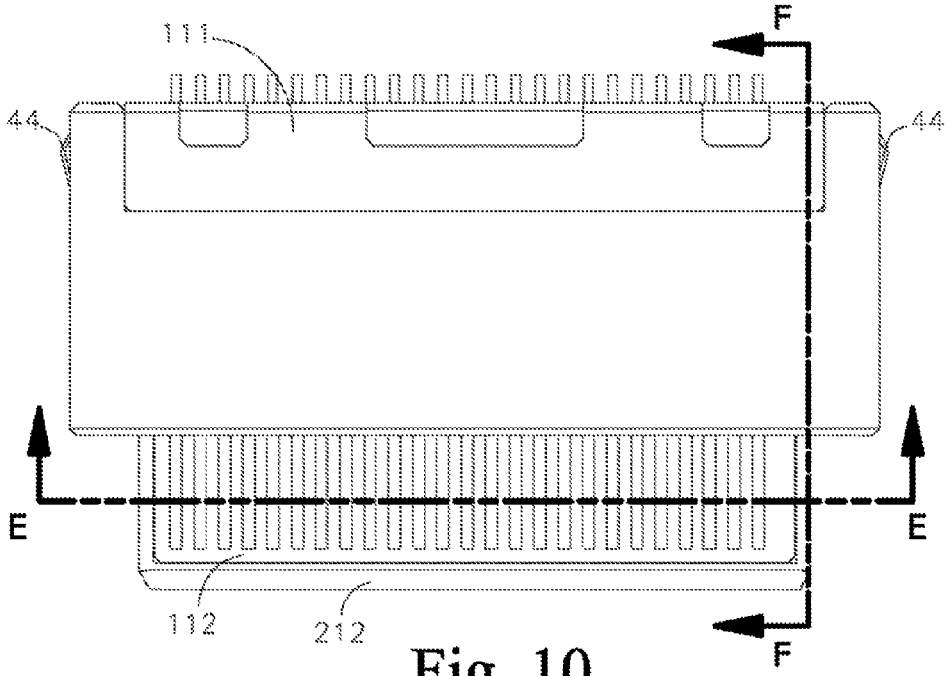
FIG. 10 is a top view of FIG. 7.
Figures 1, 10:
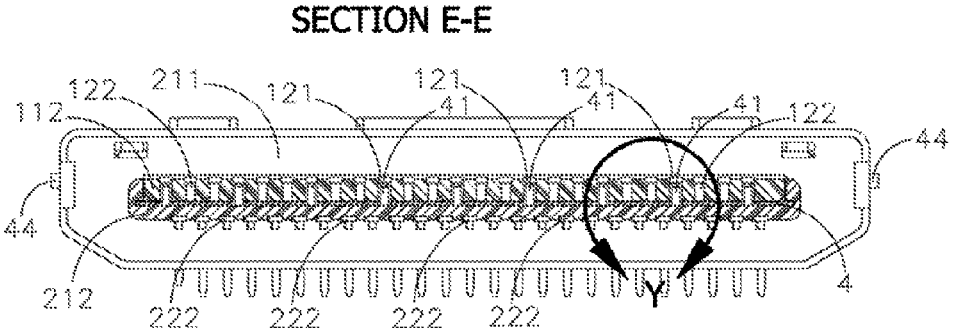
Figures 2, 10:
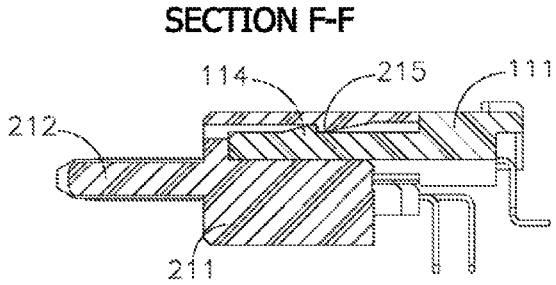
Figures 3, 10:
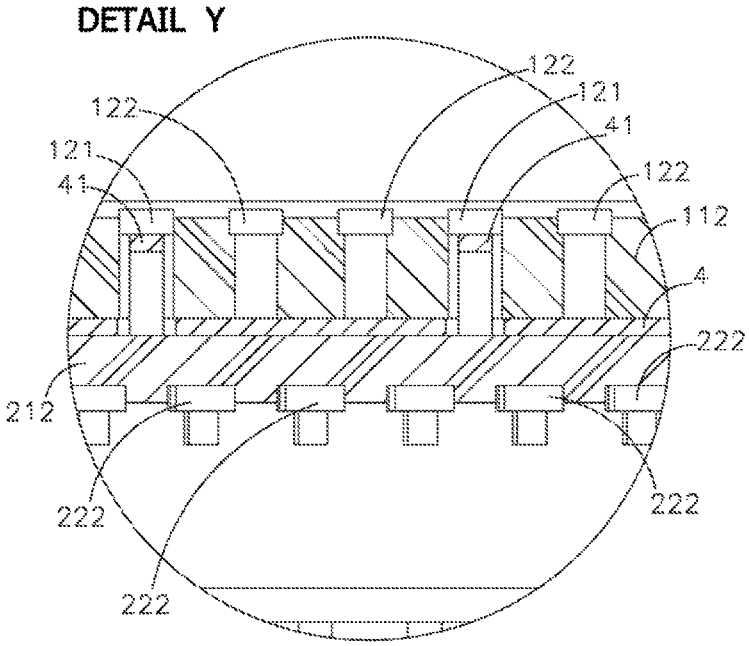
Figure 11:
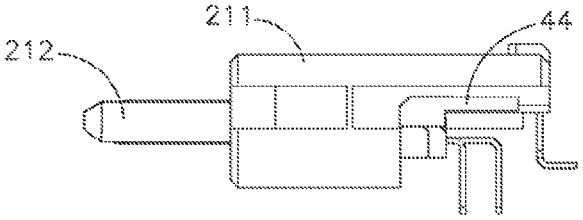
FIG. 11 is a side view of FIG. 7.

As shown in FIGS. 8, 9 and 10, similar to the first embodiment, the first insulator 11 disclosed in the second embodiment is formed by a main body portion 111 and an extending portion 112, and the second insulator 21 disclosed in the second embodiment is formed by a main body portion 211 and an extending portion 212. The main body portions 111 and 211 of the first insulator 11 and the second insulator 21 at least support the respective extending portions 112 and 212, so that the extending portions 112 and 212 are positioned as departing from the top surface or the bottom surface of the connector with a certain distance. After the first insulator 11 and the second insulator 21 are assembled, the respective extending portions 112 and 212 of the first and second insulators 11 and 21 extend jointly towards the opening 51 of the shield shell 5 (as shown in FIG. 6), so that the respective extending portions 112 and 212 of the two insulators 11 and 21 jointly form a tongue-shaped plate.

As shown in FIGS. 10 and 10-2, the groove 214 of the second insulator 21 is arranged on a surface of the extending portion 212 as being adjacent to the extending portion 112 of the first insulator 11; and the groove 214 of the second insulator 21 extends along a direction away from the opening 51 of the shield shell 5 and passes through the main body portion 211 of the second insulator 21, so that the first insulator 11 and the shield plate 4 can slide into the groove 214 of the second insulator 21 from the outer side of the main body portion 211 of the second insulator 21 towards the opening 51 of the shield shell 5. In order to retain the relative positions of the first insulator 11 and the second insulator 21, in the second embodiment, the first insulator 11 can use a pair of button hooks 114 to interfere with the corresponding stopping blocks 215 of the second insulator 21, so as to generate enough frictional force on the contacting surface of the first insulator 11 and the second insulator 21.

In the second embodiment, the shield plate 4 and the extending portion 12 of the first insulator 11 are positioned in the groove 214 in the extending portion 212 of the second insulator 21. In order to make the shield plate 4 be stably positioned between the first insulator 11 and the second insulator 21, convex fins 43 extends from two lateral sides of the shield plate 4, so that an appropriate frictional force is provided to the shield plate 4 due to the interaction of the convex fins 43 of the shield plate 4 and the surface of the groove 214 of the second insulator 21.

As shown in FIGS. 10, 10-1 and 10-3, in the second embodiment, resilient arms 41 extend from the shield plate 4 positioned between the first insulator 11 and the second insulator 21 only towards the plurality of ground line contacts 121 of the first insulator 11. This is because the frequency of the electronic signals transmitted by the signal line contacts 222 of the second sub-assembly 2 is different from that of the signal line contacts 122, and the high frequency property of the high frequency electronic signals transmitted by the signal line contacts 222 can be improved by means of shorting the distance between the shield plate 4 and the signal line contacts 222 of the second contact 22. However, similar to the first embodiment, in the second embodiment, the extending portion 112 of the first insulator 11 is provided with a plurality of through holes 113 on a surface towards the shield plate 4, so that the respective resilient arms 41 of the shield plate 4 pass through respective through holes 113. The resilient arms 41 of the shield plate 4 are electrically connected with a predetermined ground line contact 121 after passing through the through holes 113 of the first insulator 11, so that ground line contacts 121 and the shield plate 4 have the same potential.

Figure 12:
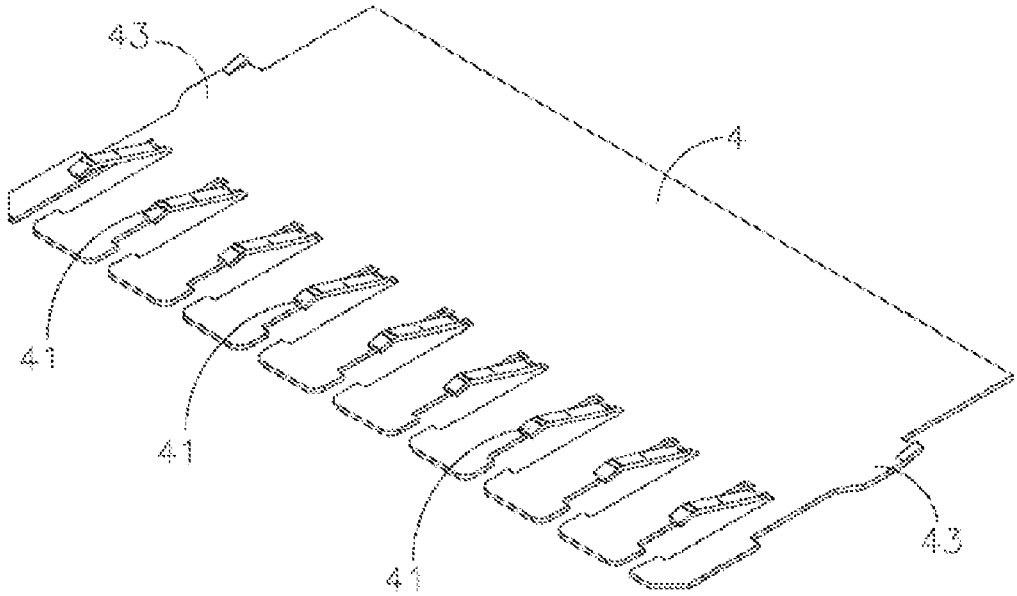
FIG. 12 is a schematic view of simplified variation of the shield plate of FIG. 6.
Figure 13:
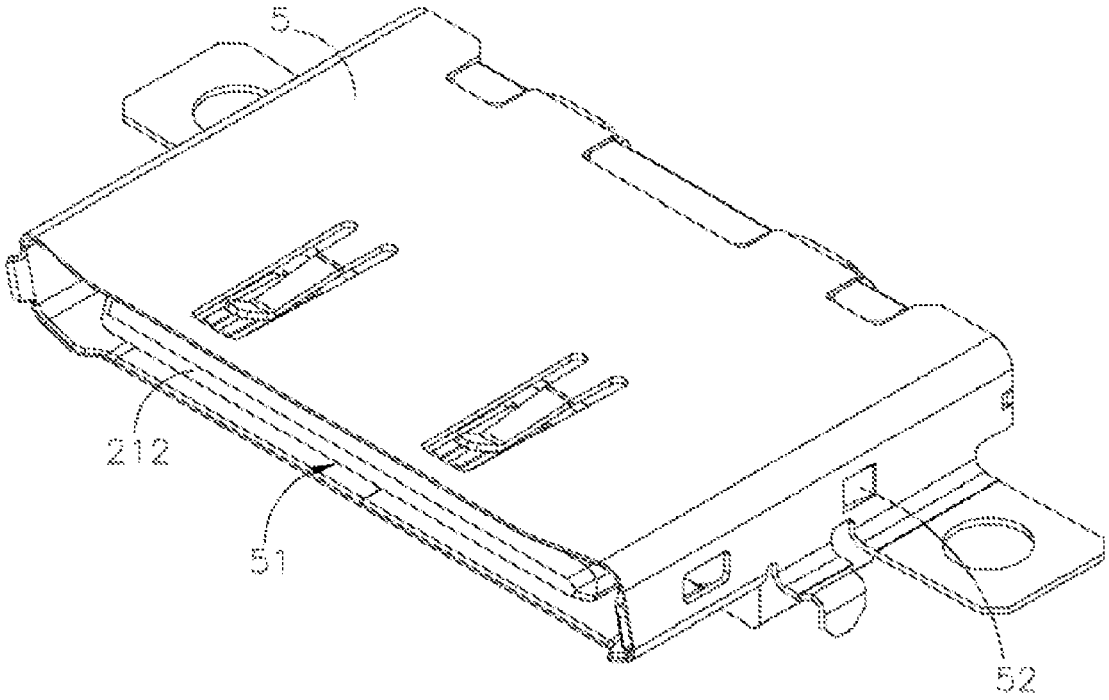
FIG. 13 is a perspective view of a third embodiment of the invention.

As shown in FIGS. 8 and 12, a plurality of contacting limbs 44 extend from the shield plate 4 disclosed in the second embodiment towards the outer side of the second insulator 21 to contact the shield shell 5, so that the whole ground efficiency of the connector is effectively improved. However, for the application of some connectors for transmitting high frequency signals, it should strictly distinguish whether grounding is performed through the shield shell 5 of the connector or through the contacts of the connector, since in an electronic device using the connectors for transmitting high frequency signals, the shield shell 5 of the connector is not electrically connected with the ground circuit (not shown) of the circuit board on which the connector is positioned. This distinguish is mainly used for protecting the electronic components of the circuit board during an electrostatic discharge (ESD) test, so that when the connector for transmitting high frequency signals is subjected to the ESD test, the high-voltage static electricity is grounded by being guided through the shield shell of the mating connector and towards the outer side of the circuit board, so that the high-voltage static electricity is not guided into the circuit board by passing through the shield plate 4. FIG. 12 of this embodiment discloses a shield plate 4 modified from that of FIG. 8. In the modified shield plate 4, the original contacting limbs 44 are removed to prevent electrical communication between the shield plate 4 and the shield shell 5, so that the high-voltage static electricity on the shield shell 5 of the connector or the shield shell of the mating connector cannot be transmitted to the ground line contacts 121 and 221, which otherwise damages the circuit board or the integrated circuit.

For the risks of the mating connector caused by the ESD test, in the fourth and fifth embodiments of the invention it is designedly avoided that the shield plate 4 and the shield shell 5 are electrically connected with each other, but the disclosure of the invention is not limited to this.

In the second embodiment, the disclosed shield plate 4 is positioned between the first contact 12 and the second contact 22 of the connector, so that the shield plate 4 can provide the impedance compensation for the signal line contacts 122 and 222 when the high frequency electronic signals passing through the signal line contacts 122 and 222. Moreover, those skilled in the art can realize the impedance compensation for the signal line contacts 122 and 222 by means of using the simplified design similar to FIG. 12 and adjusting the thickness of the shield plate 4, the positions of the resilient arms 41, the sizes of elements of resilient arms 41 or the shape of the shield plate 4.

As shown in FIGS. 13, 14, 15 and 15-1, a third embodiment of the invention is mainly modified from the second embodiment, so that the following description and disclosure of drawings in the third embodiment can use the same term, definition and numerical number as referred in the first and second embodiments for the component corresponding to that of the first and second embodiments. The structures and features which do not disclosed in details in the third embodiment can be inferred with reference to the description and drawing illustration of the first embodiment and the second embodiment by those skilled in the art.

Figure 14:
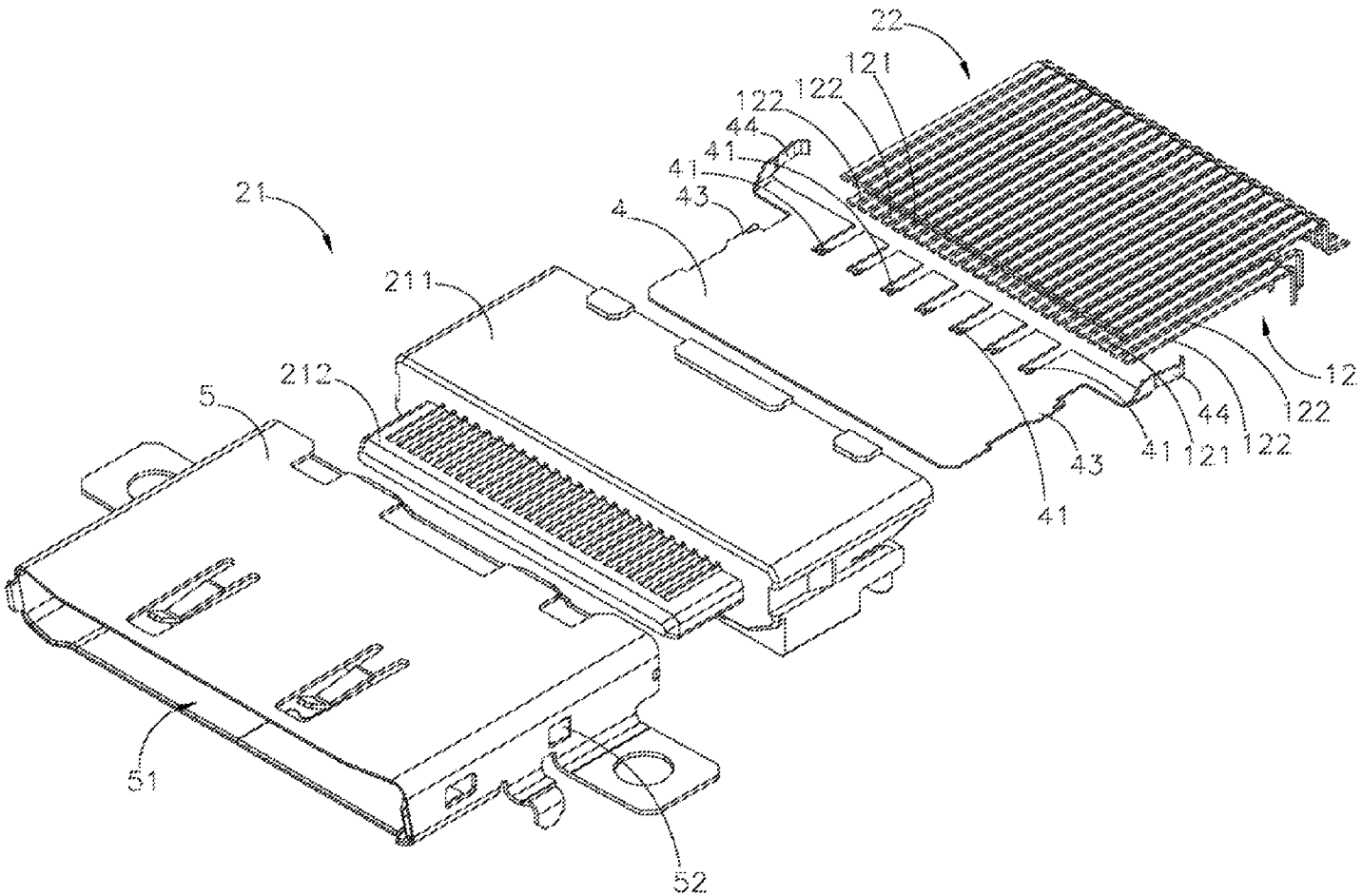
FIG. 14 is a perspective exploded view of FIG. 13.

The main difference between the third and second embodiments is that: in the second embodiment, each first contact 12 and each second contact 22 respectively interfere with the first insulator 11 and the second insulator 21 which are independent with each other (as shown in FIG. 8); but in the third embodiment, only a single second insulator 21 is used to hold the first contact 12 and the second contact 22, and the first insulator 11 of the second embodiment which is independent and can be separated from the second insulator 21 does not exist. At this time, it should be considered that the first insulator 11, which cannot be separated from the second insulator 21, is manufactured as a part of the second insulator 21, rather than considered that the third embodiment lacks the first insulator 11, which means that the first insulator 11 is an inseparable part of the second insulator 21. Therefore, the third embodiment only has a single second insulator 21 including a main body portion 211 and an extending portion 212, and thus in the third embodiment the tongue-shaped plate only refers to the extending portion 212 of the second insulator 21 extending from the main body portion 211 of the second insulator 21 towards the opening 51 of the shield shell 5 (as shown in FIGS. 14 and 15).

Furthermore, in the second and third embodiments, the first contact 12 and the second contact 22 are respectively arranged at two opposite upper and lower surfaces of the tongue-shaped plate. In the second embodiment, the resilient arms 41 of the shield plate 4 each contact the ground line contacts 121 arranged on the upper surface of the tongue-shaped plate; and in the third embodiment, the resilient arms 41 of the shield plate 4 each contact the ground line contacts 121 arranged on the lower surfaces of the tongue-shaped plate. The resilient arms 41 of the shield plate 4 in the second embodiment only each contact the ground line contacts 121 on a single surface of the tongue-shaped plate, so that the arrangement of the first contact 12 and the second contact 22 should be regarded as oppose to that of the second embodiment.

Figure 15:
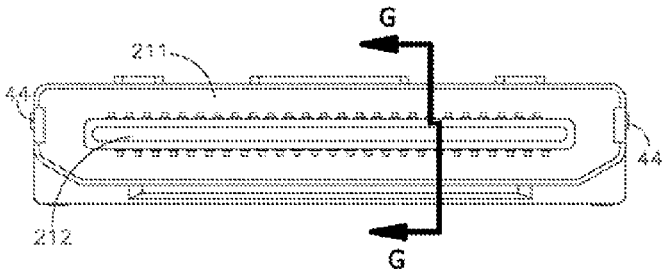
FIG. 15 is a front view of FIG. 13, in which the shield shell is omitted.
Figures 1, 15:
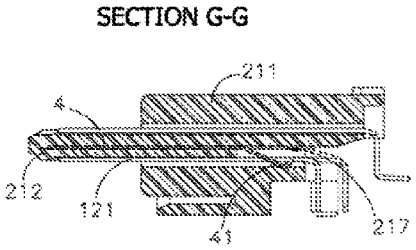

In the third embodiment, a guided groove 217 is arranged at a predetermined position between the first contact 12 and the second contact 22 of the first second insulator 21 (as shown in FIG. 15-1). The guided groove 217 can accommodate the shield plate 4, and the two side edges of the shield plate 4 respectively provided with a convex fin 43. Through the interference between the convex fin 43 of the shield plate 4 and the guided groove 217 of the second insulator 21, an appropriate frictional force is provided to the shield plate 4, so that the shield plate 4 is retained in the guided groove 217 of the second insulator 21.

Figure 16:
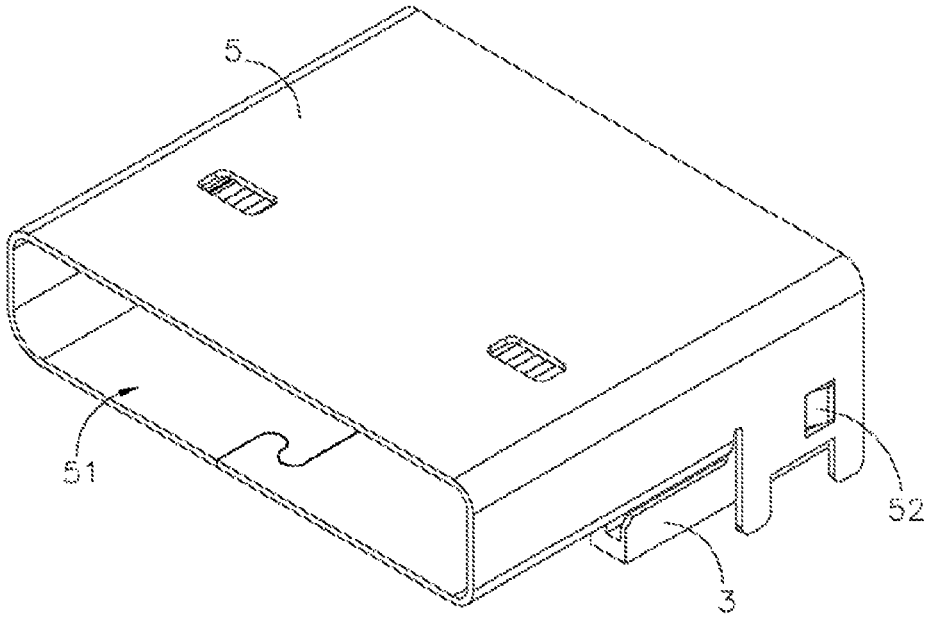
FIG. 16 is a perspective view of a fourth embodiment of the invention.
Figure 17:
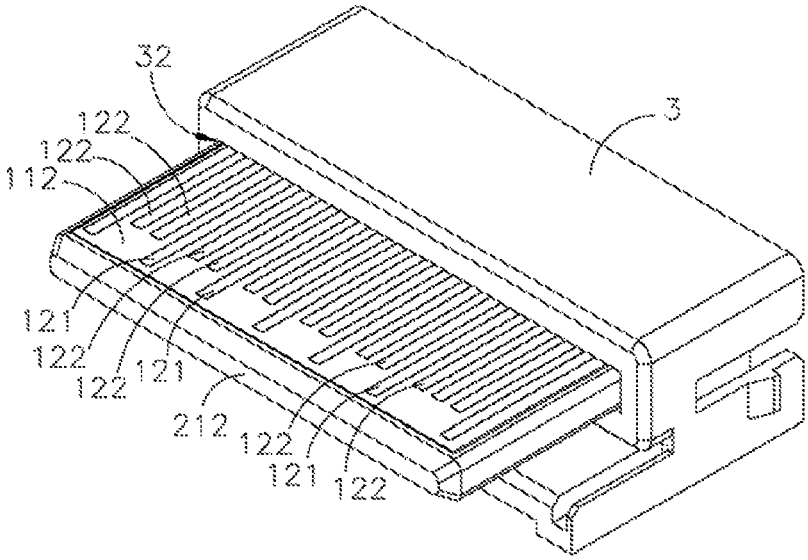
FIG. 17 is a schematic view of FIG. 16, in which the shield shell is omitted.
Figure 18:
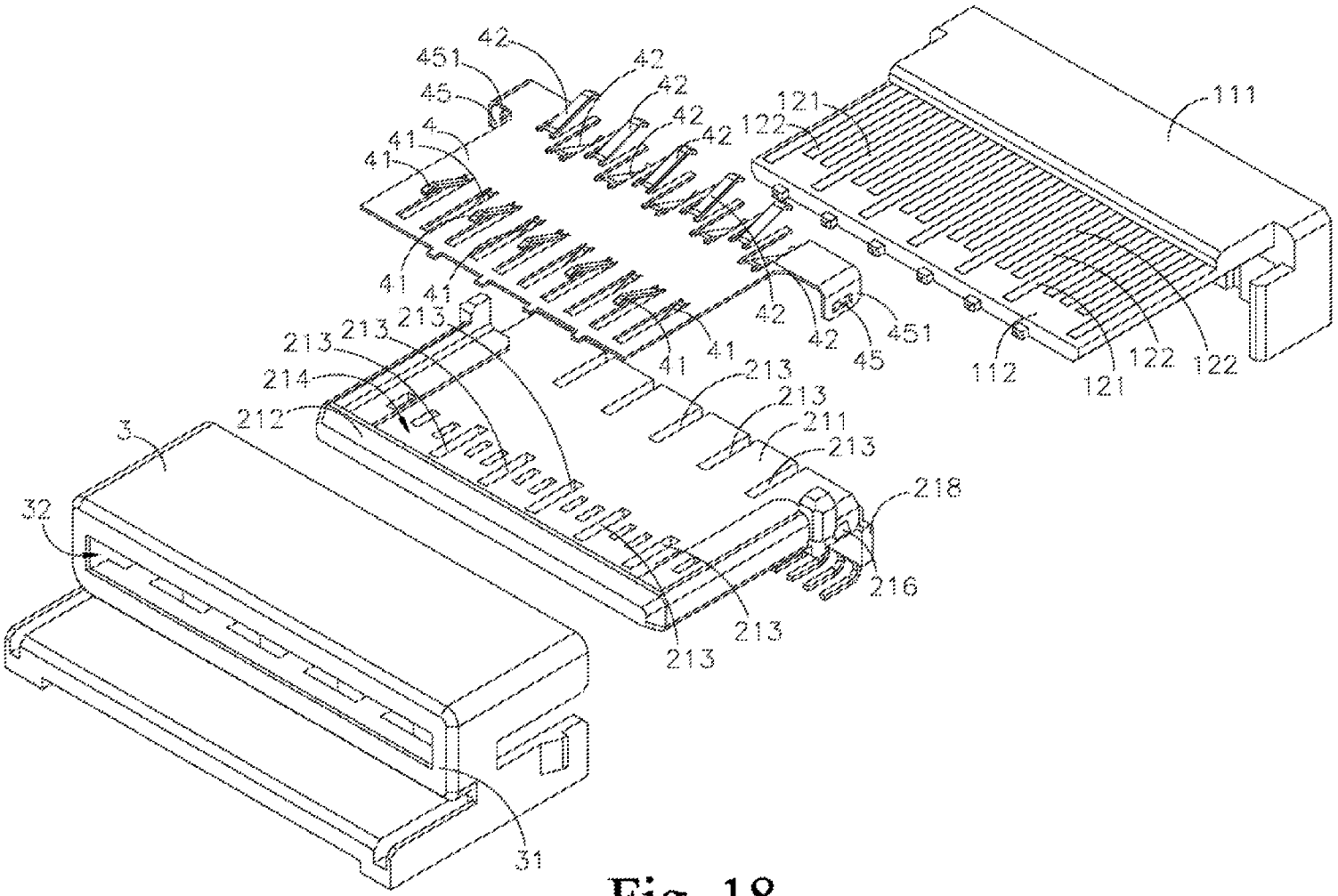
FIG. 18 is a perspective exploded view of FIG. 17.
Figures 2, 19:
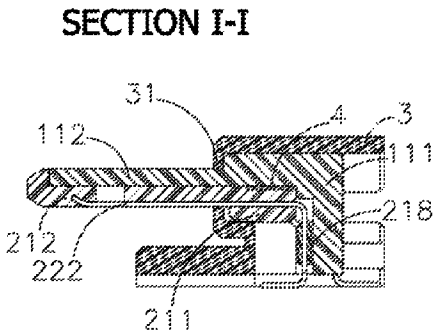
FIG. 19 is a front view of FIG. 17.
Figures 1, 19:
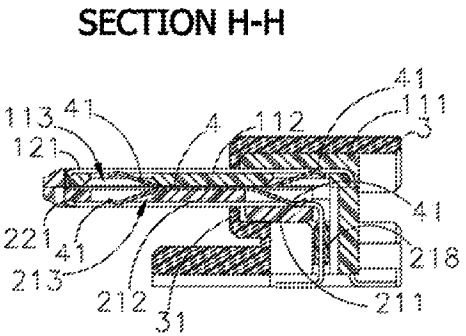
Figure 19:
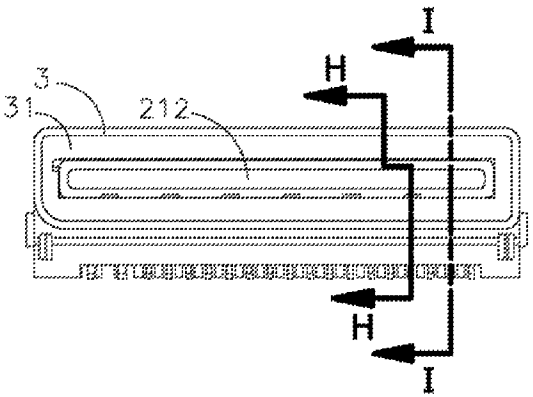

As shown in FIGS. 16, 17 and 18, a fourth embodiment of the invention mainly discloses a high density connector structure including a first sub-assembly 1, a second sub-assembly 2, a shield plate 4 and a shield shell 5. The first sub-assembly 1 is formed by a first insulator 11 and a set of first contacts 12 held in the first insulator 11, and the second sub-assembly 2 is formed by a second insulator 21 and a set of second contacts 22 held in the second insulator 21. Similar to the first embodiment, in the fourth embodiment, the first insulator 11 is formed by a main body portion 111 and an extending portion 112, and the second insulator 21 is formed by a main body portion 211 and an extending portion 212. The main body portions 111 and 211 of the first insulator 11 and the second insulator 21 at least respectively support the extending portions 112 and 212, so that the extending portions 112 and 212 are arranged as departing from the top surface or the bottom surface of the whole connector with a certain distance and jointly form a tongue-shaped plate. As shown in the figures, the main body portion 211 and the extending portion 212 of the second insulator 21 have no obvious separation boundary, but the thicker portion of the second insulator 21 can be regarded as the main body portion 211 and the thinner portion of the second insulator 21 can be regarded as the extending portion 212.

The shield plate 4 is formed by cutting a metal sheet material. The shield plate 4 is bent as having two sets of resilient arms. The two sets of resilient arms include the first set of plural resilient arms adjacent to the opening 51 of the shield shell 5 and the second set of plural resilient arms departing from the first set of resilient arms with a certain distance. The shield plate 4 is assembled and positioned between the first sub-assembly 1 and the second sub-assembly 2. The shield shell 5 at least partially surrounds the periphery of the first contact 12 and the second contact 22, and an opening 51 is preset on the shield shell 5 at a mating surface of the connector, so that the connector can mate with a mating connector (not shown) through the opening 51 of the shield shell 5.

As shown in FIGS. 18, 19, 19-1 and 19-2, in the fourth embodiment, the first set of resilient arms and the second set of resilient arms of the shield plate 4 respectively have a plurality of resilient arms 41 extending towards predetermined ground line contacts 121 of the first contact 12 and a plurality of resilient arms 42 extending towards predetermined ground line contacts 221 of the second contact 22. The shield plate 4 is assembled between the extending portion 112 of the first insulator 11 and the extending portion 212 of the second insulator 21, so that in order to make the respective resilient arms 41 and 42 of the shield plate 4 pass through the extending portions 112 and 212 of the first insulator 11 and the second insulator 21 and contact appropriate ground line contacts 121 and 221, the first insulator 11 and the second insulator 21 are provided with multiple through holes 113, 213 at appropriate positions, and thus the multiple predetermined ground line contacts 121 and 221 which contact with the resilient arms 41 and 42 of the shield plate 4 has the same potential as the shield plate 4.

In the fourth embodiment, the ground line contacts 121 of the first contacts 12 and the ground line contacts 221 of the second contacts 22 each contact the first predetermined set of resilient arms 41 and the second predetermined set of resilient arms 42 of the shield plate 4 at the same time, which means that a single one of the ground line contacts 121 and 221 contacts two resilient arms 41 and 42 of the shield plate 4 at the same time. The shield plate 4 use the plurality of resilient arms 41 and 42 to multi-point contact the predetermined ground line contacts 121 and 221 at the same time, so that the micro stray charges on the ground line contacts 121 and 221 which contact the plurality of resilient arms 41 and 42 are transmitted to the shield plate 4 rapidly through the plurality of resilient arms 41 and 42 of the shield plate 4. Therefore, the means of using the plurality of resilient arms 41 and 42 of the shield plate 4 to contact the same one of the ground line contacts 121 and 221 at the same time can be considered as a means for increasing the contacting area between the ground line contacts 121, 221 and the shield plate 4. The two sets of resilient arms of the shield plate 4 are departed from each other with a certain distance, and the respective ground line contacts 121, 221 contact two resilient arms 41, 42 of the shield plate 4 at the same time, so that by changing the shapes and sizes of the shield plate 4 and the resilient arms 41, 42, the signal line contacts 1222, 222 can obtain an appropriate impedance compensation when high frequency electronic signals are transmitted, which is beneficial for mediate the impedance variation when the high frequency electronic signals are transmitted in the connector.

In the fourth embodiment, the plurality of resilient arms 41, 42 of the shield plate 4 are arranged as two sets, so that the extending portion 212 of the second insulator 21 is provided with two sets of through holes 213 at a surface adjacent to the shield plate 4, and thus the respective resilient arms 41, 42 of the shield plate 4 can pass through the through holes 213 to contact the predetermined ground line contacts 221. Due to perspective factors, in the figures of the fourth embodiment, the extending portion 112 of the first insulator 11 is not shown as having two sets of through holes 113 at a surface adjacent to the shield plate 4, but the existence of the through holes 113 of the first insulator 11 can be inferred from the disclosure of FIG. 19-1.

In the fourth embodiment, the first sub-assembly 1 formed by the first insulator 11 and the first contact 12 and the second sub-assembly 2 formed by the second insulator 21 and the second contact 212 are both restrained at predetermined positions of a third insulator 3. The third insulator 3 has a separation wall 31, and the separation wall 31 of the third insulator 3 has a window 32 thereon. The assembled extending portions 112 and 212 of the first insulator 11 and the second insulator 21 pass through the window 32 of the third insulator 3 to form the tongue-shaped plate. The first contact 12 held in the first insulator 11 and the second contact 22 held in the second insulator 21 are arranged in two opposite surfaces of the tongue-shaped plate.

In the fourth embodiment, in order to decrease the height of the tongue-shaped plate, the extending portion 212 of the second insulator 21 is provided with a groove 214 at a surface adjacent to the shield plate 4, and thus the extending portion 112 of the first insulator 11 and the shield plate 4 can be laminated in the groove 214 of the second insulator 21. Also, in order to provide enough frictional force to the shield plate 4 positioned between the extending portions 112 and 212 of the first insulator 11 and the second insulator 21, the shield plate 4 of the fourth embodiment does not use a interference means similar to the convex fins 43 of the second embodiment (as shown in FIG. 8). Instead, two tabs 45 respectively extend from two sides of the shield plate 4, and each one of the tabs 45 is provided with a restraining hole 451. Two convex shoots 216 respectively extend from two sides of the second insulator 21 towards the restraining holes 451 of the shield plate 4. In such a way, the restraining holes 451 of the shield plate 4 and the convex shoots 216 of the second insulator 21 interfere with each other to provide enough frictional force to the shield plate 4.

Generally, the contacts of the connector may be deformed permanently due to an external force during delivery, operation process on production line and packaging operation thereof, which causes that the predetermined contacts are too close to the adjacent contacts unexpectedly. In order to solve the conventional problem, in the fourth embodiment of the invention, the second contact 22 of the second sub-assembly 2 is provided with an assistant component 218 at a position adjacent to a circuit board (not shown). The assistant component 218 is made of insulating materials, to avoid electrical communication between adjacent second contacts as being too close to each other.

In the fourth embodiment, the assistant component 218 interfere respectively with the ground line contacts 221 and the signal line contacts 222 of the second contact 22, so that the assistant component 218 can obtain enough frictional force to retain the predetermined distance between the ground line contacts 221 and the signal line contacts 222. However, from a micro perspective, since the production of ground line contacts 221 and the signal line contacts 222 has tolerances, the ground line contacts 221 and the signal line contacts 222 assembled after the second insulator 21 may be inclined with certain minor degrees rather than being exactly parallel to each other, which means, to the high density connector, the inclination tolerances of the contacts can be used to clamp the assistant component 218 to form a floating-type assistant component 218.

In the fourth embodiment, the assistant component 218 is directly formed on the surface of the second contact 22 through an insert molding manufacturing method, so that the assistant component 218, the ground line contacts 221 and the signal line contacts 222 can have enough frictional force. However, the fourth embodiment is only an application of the invention, so that whether the assistant component 218 is directly held on the first contacts 12 through an interference method or relatively held on the first contacts 12 through a floating method can be easily inferred from the fourth embodiment, without needing of illustrating in drawings.

Figure 20:
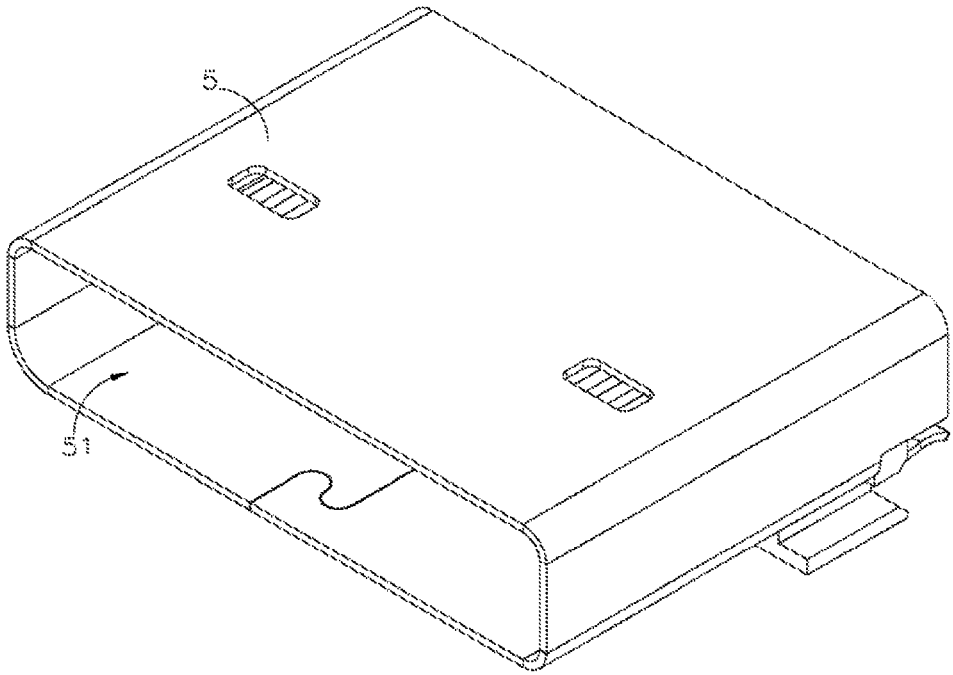
FIG. 20 is a perspective view of a fifth embodiment of the invention.
Figure 21:
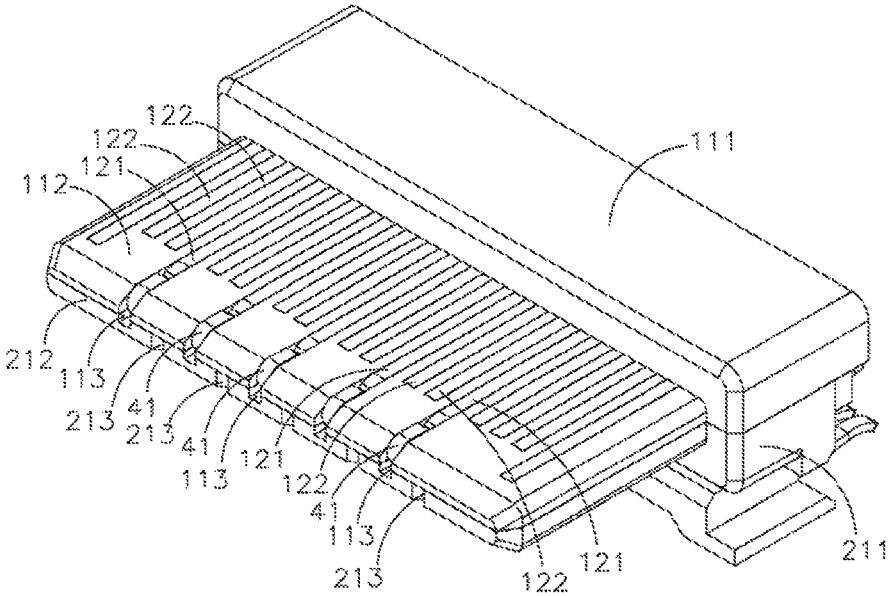
FIG. 21 is a schematic view of FIG. 20, in which the shield shell is omitted.
Figure 22:
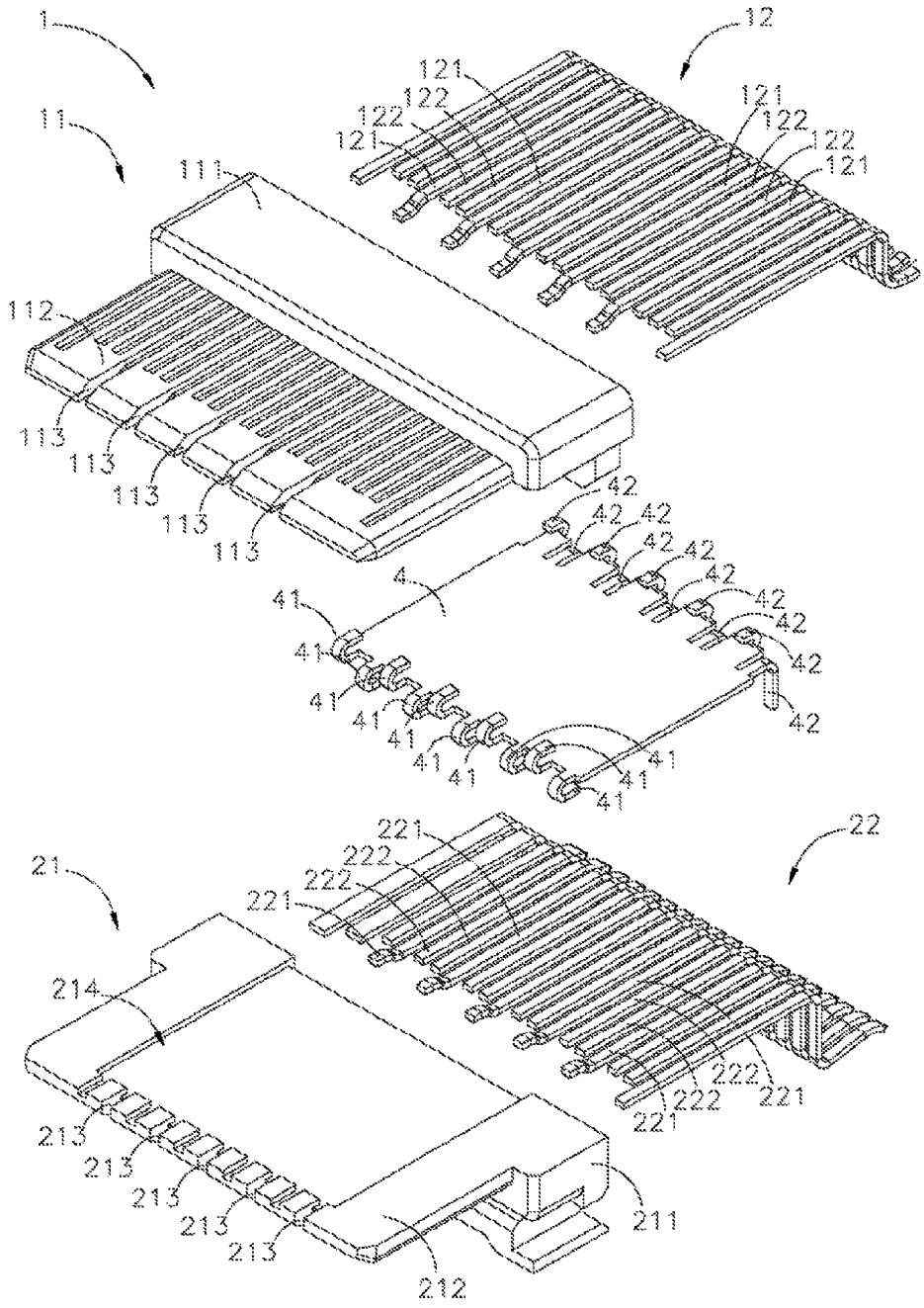
FIG. 22 is a perspective exploded view of FIG. 21.

As shown in FIGS. 20, 21 and 22, a fifth embodiment of the invention mainly discloses a high density connector structure including a first sub-assembly 1, a second sub-assembly 2, a shield plate 4 and a shield shell 5. The first sub-assembly 1 is formed by a first insulator 11 and a set of first contacts 12 interfere with the first insulator 11, and the second sub-assembly 2 is formed by a second insulator 21 and a plurality of second contacts 22 interfere with the second insulator 21. The shield plate 4 is formed by cutting a metal sheet material. The shield plate 4 is bent as having two sets of plural U-shaped resilient arms 41 and 42 with elastic-restoring forces. The shield plate 4 is positioned between the first sub-assembly 1 and the second sub-assembly 2. The shield shell 5 at least partially surrounds the periphery of the first contact 12 and the second contact 22, and an opening 51 is preset on the shield shell 5 at a mating surface of the connector, so that the connector can mate with a mating connector through the opening 51 of the shield shell 5.

The part of the fifth embodiment similar to the first embodiment is that, in the fifth embodiment the first insulator 11 is formed by a main body portion 111 and an extending portion 112, and the second insulator 21 is formed by a main body portion 211 and an extending portion 212. The main body portions 111 and 211 of the first insulator 11 and the second insulator 21 at least respectively support the extending portions 112 and 212, so that the extending portions 112 and 212 are arranged as departing from the top surface or the bottom surface of the whole connector with a certain distance. After the first insulator 11 and the second insulator 21 are assembled, the respective extending portions 112 and 212 of the first and second insulators 11 and 21 extend jointly towards the opening 51 of the shield shell 5 (as shown in FIG. 20), so that the respective extending portions 112 and 212 of the two insulators 11 and 21 jointly form a tongue-shaped plate. Furthermore, the extending portion 212 of the second insulator 21 is provided with a groove 214 on a surface facing the extending portion 112 of the first insulator 11. The groove 214 of the second insulator 21 at least can accommodate the shield plate 4, so as to decrease the height of the shield plate 4 exposed from the extending portion 212 of the second insulator 21. In an ideal condition, the depth of the groove 214 of the second insulator 21 should be greater than the thickness of the shield plate 4, so that the groove 214 of the second insulator 21 at least can accommodate the extending portion 112 of the first insulator 11 partially, to decrease the entire height of the tongue-shaped plate after the two insulators are assembled.

Figures 1, 23:
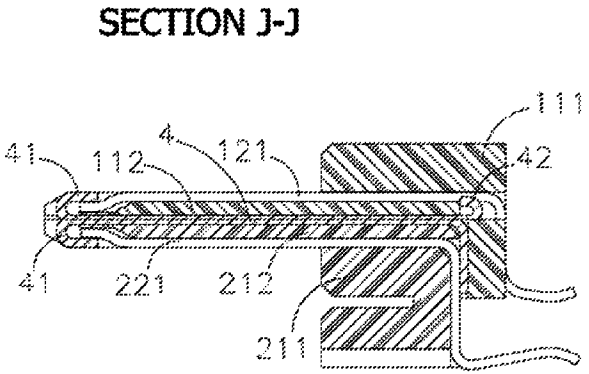
FIG. 23 is a front view of FIG. 21.
Figure 23:
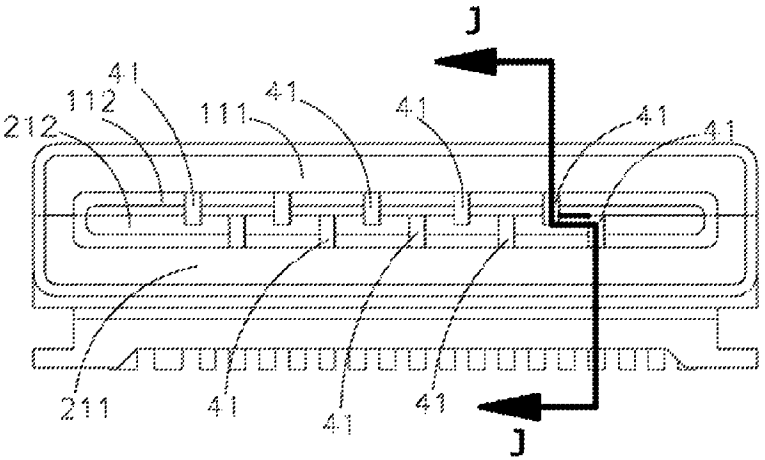
Figure 24:
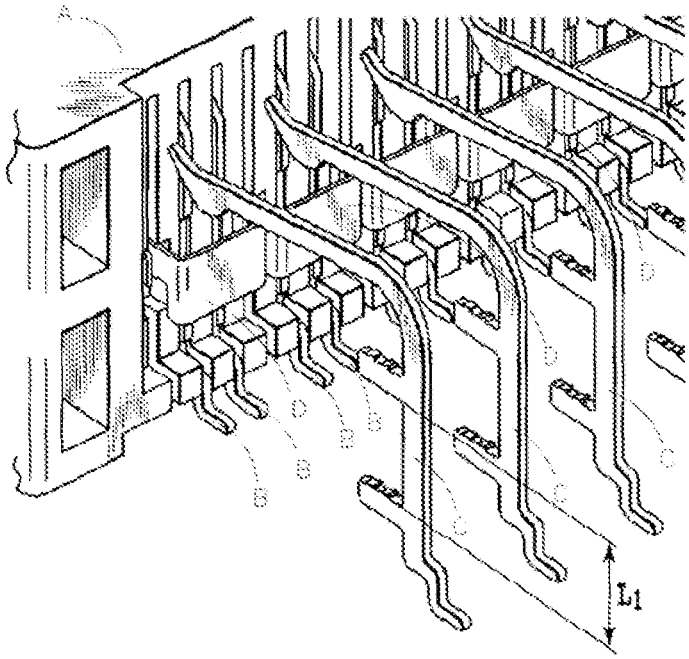
FIG. 24 is a schematic view of the prior art disclosed in the U.S. Pat. No. 8,167,631.
Figures 2, 25:
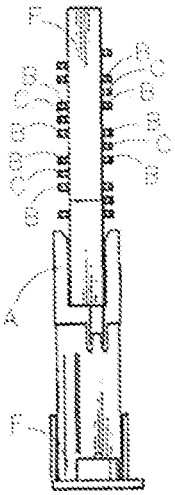
FIG. 25-2 ( PRIOR ART )
FIG. 25 is a schematic view of the prior art disclosed in the U.S. Pat. No. 7,524,193.
Figure 25:
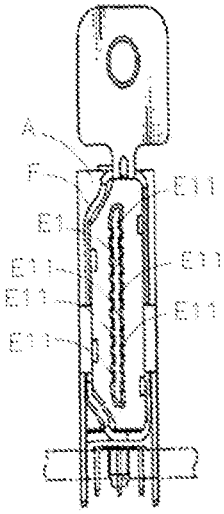
FIG. 25 ( PRIOR ART )
Figures 1, 25:
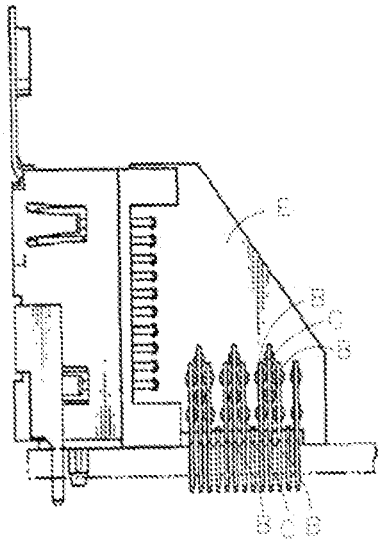
FIG. 25-1 ( PRIOR ART )

As shown in FIGS. 22, 23 and 23-1, in the fifth embodiment the plurality of resilient arms 41 and 42 of the shield plate 4 is divided into two sets, i.e., the first set of resilient arms formed by the plurality of resilient arms 41 closer to the opening 51 of the shield shell 5, and the second set of resilient arms formed by the plurality of resilient arms 42 which depart from the first set of resilient arms with a certain distance. The first set of plural resilient arms 41 extend from the shield plate 4 and is bent as U shape towards two opposite surfaces of the shield plate 4, so that the ground line contacts 121 of the first sub-assembly 1 are clamped by the plurality of resilient arms 41 of the shield plate 4. The U-shaped bent resilient arms 41 of the shield plate 4 are used to provide an elastic clamping force to clamp the ground line contacts 121, so that the relative positions of the shield plate 4 and the first sub-assembly 1 can be determined. Similarly, the retained relative positions of the shield plate 4 and the second sub-assembly 2 can also be determined through the first set of plural U-shaped bent resilient arms 41 of the shield plate 4. By using the shield shell 5 to restrain the first insulator 11 of the first sub-assembly 1 and the second insulator 21 of the second sub-assembly 2, the relative positions of the first sub-assembly 1, the shield plate 4 and the second sub-assembly 2 can be retained.

In the fifth embodiment, the second set of plural resilient arms 42 of the shield plate 4 are bent upwards (towards the extending portion 112 of the first insulator 11) as U shape or bent downwards (towards the extending portion 212 of the second insulator 21) as L shapes. The U-shaped resilient arms 42 each elastically abut against the ground line contacts 121 of the first sub-assembly 1, and the ground line contacts 121 of the first sub-assembly 1 are clamped by the first set of plural resilient arms 41, so that the first ground line contacts 121 and the shield plate 4 have at least two current paths. Similarly, the L-shaped resilient arms in the second set of plural resilient arms 42 of the shield plate 4 each elastically abut against the ground line contacts 221 of the second sub-assembly 2, and the ground line contacts 221 of the second sub-assembly 2 contact the second set of plural resilient arms 42, so that the second ground line contacts 221 and the shield plate 4 have at least two current paths. Since the ground line contacts 121 of the first sub-assembly 1 and the ground line contacts 221 of the second sub-assembly 2 respectively have two current paths with the shield plate 4, the shield plate 4 at least have two path exchange electric potentials respectively with the ground line contacts 121 and 221, which can ensure that the ground line contacts 121 and 221 electrically connected with the shield plate 4 have the same electric potential. Those skilled in the art can change the shape of the plurality of resilient arms 41 and 42 of the shield plate 4 of the fifth embodiment, so as to use the effect of different shapes of the signal line contacts 122 and 222 when the high frequency electronic signals are transmitted on the signal line contacts 122 and 222 as means for impedance compensation.

In the fifth embodiment, the first contacts 12 interfere with the first insulator 11 to form the first sub-assembly 1, and the second contacts 22 interact with the second insulator 21 to form the second sub-assembly 2; and the first set of plural resilient arms 41 of the shield plate 4 clamp the ground line contacts 121 and 221 of the first sub-assembly 1 and the second sub-assembly 2 at the front edges thereof adjacent to the opening 51 of the shield shell 5. Therefore, the first set of plural resilient arms 41 of the shield plate 4 extend beyond the ends of the ground line contacts 121 and 221, and similarly the multiple through holes 113 and 213 (as shown in FIG. 18)

of the extending portions 112 and 212 of the two insulators 1 and 2 of the fourth embodiment are positioned at an end of the extending portions 112 and 212 of the two insulators 1 and 2 of the fifth embodiment as being adjacent to the opening 51 of the shield shell 5. At this time, to hold the first sub-assembly 1, the shield plate 4 and the second sub-assembly 2 in the fifth embodiment at least should include the first set of plural U-shaped bent resilient arms 41 of the shield plate 4.

In the fifth embodiment, the portions of the first contacts 12 and the second contacts 22 extending beyond the first insulator 11 and the second insulator 21 may be electrically connected with a circuit board (not shown), and it can be seen from FIGS. 23-1 and 23-2 that the first contacts 12 and the second contacts 22 may be electrically connected to two opposite surfaces of the circuit board at the same time. The formed connector crosses the two opposite surfaces of the circuit board, so that the connector is referred to as the straddle mount connector, and the first contacts 12 and the second contacts 22 are straddle contacts.

The disclosed embodiments of the invention are all directed to a high density connector structure for transmitting high frequency signals, so that the electrical characters of respective components of the connector should be considered carefully, especially for the impedance variation in the paths for transmitting high frequency electronic signals on the signal line contacts 122 and 222, which can avoid return loss of the high frequency electronic signals due to the impedance variation of the connector, and otherwise energy loss of the high frequency electronic signals or distortion of the high frequency electronic signals due to crosstalk may be caused. In the disclosures of the above embodiments, the shield plate 4 is formed by cutting a metal sheet material, so that through the effect of shielding electromagnetic waves of the metal materials, the electromagnetic crosstalk of the high frequency electronic signals passing through the signal line contacts 122 and 222 can be effectively avoided.

In the disclosures of the above embodiments, the detailed components of the shield plates are designed with different sizes, which aims to make those of skills in the art understand that this invention can be applied in different kinds of connectors, including the board end connector and the cable end connector, and meanwhile the contacts of the connector may be surface mount contacts, through hole contacts or straddle contacts.

In view of the above, the technology disclosed in the invention can be not only applied in the above embodiments, and those skilled in the art can use the above embodiments directly or through modification with reference to the disclosure of the invention. Any application or modification made by those skilled in the art with reference to the disclosure of the invention belongs to equivalent application or modification of the invention, without departing from the scope of the claims of the invention.

What is claimed is:

1. A high density connector structure for transmitting high frequency signals, comprising:

a first sub-assembly comprising a plurality of first contacts held in a first insulator;

a second sub-assembly comprising a plurality of second contacts held in a second insulator;

a shield plate disposed between the first and second contacts, wherein the shield plate is a metal sheet;

a shield shell at least partially surrounding a periphery of the first and second sub-assemblies; and at least one resilient arm extended from the shield plate and electrically connected to at least one of the first contacts of the first sub-assembly.

2. The high density connector structure for transmitting high frequency signals of claim 1, wherein the first and second sub-assemblies are restrained in a third insulator.

3. The high density connector structure for transmitting high frequency signals of claim 2, wherein shield shell surrounds the periphery of the first and second sub-assemblies by partially surrounding the periphery of the third insulator.

4. The high density connector structure for transmitting high frequency signals of claim 1, wherein the shield plate has a plurality of the resilient arms, at least one of the resilient arms of the shield plate contact the least one first contact of the first sub-assembly, and plural of the plurality of the resilient arms contact plural of the plurality second contacts of the second sub-assembly.

5. The high density connector structure for transmitting high frequency signals of claim 1, wherein the first sub-assembly, the shield plate and the second sub-assembly interact with each other through an assembly structure.

6. The high density connector structure for transmitting high frequency signals of claim 5, wherein the assembly structure is a structure which generates a frictional force after the assembly of the first insulator and the second insulator.

7. The high density connector structure for transmitting high frequency signals of claim 5, wherein the assembly structure is plural of the plurality of the resilient arms of the shield plate.

8. The high density connector structure for transmitting high frequency signals of claim 1, wherein the first and second insulators jointly form a tongue-shaped plate, and the tongue-shaped plate extends towards a direction for mating with a mating connector.

9. The high density connector structure for transmitting high frequency signals of claim 8, wherein the first contacts and the second contacts are arranged on two opposite surfaces of the tongue-shaped plate.

10. The high density connector structure for transmitting high frequency signals of claim 1, wherein the plurality of resilient arms of the shield plate contact the plurality of first contacts.

11. The high density connector structure for transmitting high frequency signals of claim 1, wherein the first insulator has a plurality of through holes, so that the resilient arms of the shield plate pass through the first insulator and contact the first contacts.

12. The high density connector structure for transmitting high frequency signals of claim 1, wherein the first insulator of the first sub-assembly is directly formed on the surfaces of the first contacts through an insert molding method.

13. The high density connector structure for transmitting high frequency signals of claim 1, further comprising an assistant component arranged between the second contacts to ensure the distances between adjacent second contacts.

14. The high density connector structure for transmitting high frequency signals of claim 1, wherein the shield plate is electrically connected with the shield shell.

15. The high density connector structure for transmitting high frequency signals of claim 14, wherein the shield plate has at least a side limb, and the side limb contacts the shield shell.

16. The high density connector structure for transmitting high frequency signals of claim 1, wherein the second insulator of the second sub-assembly has a groove, and the first insulator of the first sub-assembly is at least partially assembled in the groove of the second sub-assembly.

17. The high density connector structure for transmitting high frequency signals of claim 1, wherein first insulator and the second insulator are integrated as a whole, so that the first insulator is formed as one part of the second insulator.

18. The high density connector structure for transmitting high frequency signals of claim 17, wherein the integrated first insulator and the second insulator have a guided groove, and the shield plate is assembled in the guided groove.

* * * * *